US008603712B2

(12) United States Patent
Aoki et al.

(10) Patent No.: US 8,603,712 B2
(45) Date of Patent: Dec. 10, 2013

(54) TONER

(71) Applicant: Canon Kabushiki Kaisha, Tokyo (JP)

(72) Inventors: Kenji Aoki, Mishima (JP); Shuntaro Watanabe, Hadano (JP); Takaaki Kaya, Suntou-gun (JP); Tetsuya Kinumatsu, Numazu (JP); Ayako Okamoto, Wako (JP); Toshifumi Mori, Suntou-gun (JP); Yoshihiro Nakagawa, Numazu (JP); Atsushi Tani, Suntou-gun (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,372

(22) Filed: Jan. 14, 2013

(65) Prior Publication Data

US 2013/0122414 A1 May 16, 2013

Related U.S. Application Data

(63) Continuation of application No. PCT/JP2012/064335, filed on Jun. 1, 2012.

(30) Foreign Application Priority Data

Jun. 3, 2011 (JP) ..... 2011-125763
Nov. 29, 2011 (JP) ..... 2011-260888

(51) Int. Cl.
*G03G 9/087* (2006.01)

(52) U.S. Cl.
USPC ..... 430/109.1; 430/109.3; 430/109.4; 430/108.3

(58) Field of Classification Search
USPC ..... 430/108.3, 109.1, 109.3, 109.4
See application file for complete search history.

(56) References Cited

U.S. PATENT DOCUMENTS

| | | | |
|---|---|---|---|
| 5,135,833 | A | 8/1992 | Matsunaga et al. |
| 5,298,354 | A | 3/1994 | Matsunaga et al. |
| 5,300,386 | A | 4/1994 | Kanbayashi et al. |
| 5,354,639 | A | 10/1994 | Kasuya et al. |
| 5,354,640 | A | 10/1994 | Kanbayashi et al. |

(Continued)

FOREIGN PATENT DOCUMENTS

| | | | |
|---|---|---|---|
| JP | 11-231566 | A | 8/1999 |
| JP | 2006-91283 | A | 4/2006 |

(Continued)

OTHER PUBLICATIONS

Kaya, et al., U.S. Appl. No. 13/741,356, filed Jan. 14, 2013.

(Continued)

*Primary Examiner* — Peter Vajda
(74) *Attorney, Agent, or Firm* — Fitzpatrick, Cella, Harper and Scinto

(57) ABSTRACT

Provided is a toner comprising a toner particle having a core-shell structure in which a shell phase containing a resin A is formed on a core that contains a binder resin, a colorant and a wax, wherein the resin A is a vinyl resin prepared by copolymerizing a vinyl monomer X that has an organopolysiloxane structure and a vinyl monomer Y that has a polyester segment capable of forming a crystalline structure; the content of the vinyl monomer X in a total monomer used for the copolymerization is in a particular range; the toner particle contains resin A in a particular proportion; and the binder resin contains a crystalline resin.

9 Claims, 2 Drawing Sheets

(56) References Cited

U.S. PATENT DOCUMENTS

| | | | |
|---|---|---|---|
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,736,288 | A | 4/1998 | Kasuya et al. |
| 5,814,429 | A | 9/1998 | Kawakami et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,569,589 | B2 | 5/2003 | Inaba et al. |
| 6,586,151 | B1 | 7/2003 | Naka et al. |
| 6,664,016 | B2 | 12/2003 | Kanbayashi et al. |
| 6,703,176 | B2 | 3/2004 | Naka et al. |
| 6,751,424 | B2 | 6/2004 | Komatsu et al. |
| 6,875,549 | B2 | 4/2005 | Yamazaki et al. |
| 6,881,527 | B2 | 4/2005 | Moribe et al. |
| 6,905,808 | B2 | 6/2005 | Itakura et al. |
| 7,001,703 | B2 | 2/2006 | Moribe et al. |
| 7,014,969 | B2 | 3/2006 | Yachi et al. |
| 7,097,951 | B2 | 8/2006 | Moribe et al. |
| 7,147,980 | B2 | 12/2006 | Itakura et al. |
| 7,150,953 | B2 | 12/2006 | Yamazaki et al. |
| 7,229,727 | B2 | 6/2007 | Itakura et al. |
| 7,238,387 | B2 | 7/2007 | Ogawa et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,361,441 | B2 | 4/2008 | Itakura et al. |
| 7,402,368 | B2 | 7/2008 | Ogawa et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,776,501 | B2 | 8/2010 | Tamura et al. |
| 7,794,908 | B2 | 9/2010 | Kaya et al. |
| 7,794,909 | B2 | 9/2010 | Kaya et al. |
| 7,811,734 | B2 | 10/2010 | Ogawa et al. |
| 7,935,771 | B2 | 5/2011 | Fukui et al. |
| 7,939,231 | B2 | 5/2011 | Ogawa et al. |
| 7,943,281 | B2 | 5/2011 | Kaya et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,372,573 | B2 | 2/2013 | Ayaki et al. |
| 8,383,312 | B2 | 2/2013 | Fujimoto et al. |
| 2003/0118929 | A1* | 6/2003 | Shirai et al. ..... 430/108.7 |
| 2008/0286675 | A1 | 11/2008 | Tani et al. |
| 2010/0062355 | A1 | 3/2010 | Kaya et al. |
| 2011/0020741 | A1 | 1/2011 | Mizumori |
| 2011/0039200 | A1 | 2/2011 | Kaya et al. |
| 2011/0045398 | A1 | 2/2011 | Sekikawa et al. |
| 2011/0136054 | A1 | 6/2011 | Watanabe et al. |
| 2011/0300478 | A1 | 12/2011 | Sekikawa et al. |
| 2012/0045717 | A1 | 2/2012 | Hiroko et al. |
| 2012/0171607 | A1 | 7/2012 | Ayaki et al. |
| 2012/0231384 | A1 | 9/2012 | Aoki et al. |
| 2013/0034809 | A1 | 2/2013 | Iwata et al. |

FOREIGN PATENT DOCUMENTS

| | | | |
|---|---|---|---|
| JP | 2009-30002 | A | 2/2009 |
| JP | 2009-168915 | A | 7/2009 |
| JP | 2010-132851 | A | 6/2010 |
| JP | 2010-150535 | A | 7/2010 |
| JP | 2010-168522 | A | 8/2010 |
| WO | 2011/129058 | A1 | 10/2011 |

OTHER PUBLICATIONS

Watanabe, et al., U.S. Appl. No. 13/741,359, filed Jan. 14, 2013.
Kinumatsu, et al., U.S. Appl. No. 13/741,369, filed Jan. 14, 2013.
Span, et al., "A New Equation of State for Carbon Dioxide Covering the Fluid Region from the Triple-Point Temperature to 1100 K at Pressures up to 800 MPa", Journal of Physical and Chemical Reference Data, vol. 25, No. 6, 1996, pp. 1509-1596.
PCT International Search Report and Written Opinion of the International Searching Authority, International Application No. PCT/JP2012/064335, Mailing Date Aug. 7, 2012.
Polymer Data Handbook: Basic Edition, The Society of Polymer Science, Japan: Baifukan Co., Ltd., 1986, pp. 258-724.

* cited by examiner

TONER

This application is a continuation of International Application No. PCT/JP2012/064335, filed Jun. 1, 2012, the contents of which are incorporated by reference herein.

BACKGROUND OF THE INVENTION

1. Field of the Invention

The present invention relates to a toner that is used in electrophotographic systems, electrostatic recording systems, and toner jet recording systems. More particularly, the present invention relates to a toner for use in copiers, printers and facsimile machines that produce a fixed image by forming a toner image on an electrostatic latent image bearing member, thereafter forming a toner image by transfer the toner image to a transfer material, and fixing the toner image by the application of heat and pressure.

2. Description of the Related Art

With the growth in worldwide demand for copiers and printers in recent years, there has been desire for copiers and printers that can be used in a wide variety of environments.

Heavy users require a high durability without a decline in image quality even at large numbers of copies or prints. Small offices and households, on the other hand, require the consistent production of high-quality images with no influence from the use environment, particularly, the temperature and humidity.

As a consequence, of course a high durability and also a humidity-independent charging performance are required of the toner.

Organopolysiloxanes are known to be materials that exhibit a low interfacial tension. It can therefore be expected that the introduction of an organopolysiloxane structure into the surface region of toner would provide a humidity-independent charging performance, and various investigations in this regard have also been carried out to date.

Organopolysiloxanes, on the other hand, typically have a glass transition temperature (Tg) below room temperature, and thus, when present in large amounts in a toner, the toner softens and the durability readily deteriorates. In addition, the adhesiveness between the melted toner and paper is reduced and the toner readily separates from the fixed image. As a consequence, the additive amount of organopolysiloxane and the state in which it is present must be controlled.

Japanese Patent Application Laid-open No. 2010-132851 discloses a toner with a core-shell structure that contains an organopolysiloxane compound as a binder resin. This art provides an excellent releasability of the toner from the heat-fixing roll and yields an image that is stable on a long-term basis. However, this art uses the organopolysiloxane compound not only for the shell, but also as the core material, and as a consequence the toner has an overly large content of the organopolysiloxane structure. This has resulted in the problem of facile separation of the toner from the fixed image.

Japanese Patent Application Laid-open No. 2010-132851 discloses an example in the realm of resin particle production in which resin particles are obtained by using supercritical carbon dioxide or a fluid that is a nonaqueous medium as a dispersion medium and using a compound having an organopolysiloxane structure as a dispersion stabilizer. It was found, however, that this art does not provide a stability in a variety of environments, because the compound having an organopolysiloxane structure is used in the form of a solution in this art, a structure in which this compound remains at the surface of the resulting resin particles does not occur.

With respect to resin particle production in the aforementioned dispersion medium, Japanese Patent Application Laid-open No. 2010-168522 describes an example in which a compound containing an organopolysiloxane structure is used as a toner shell material. However, the organopolysiloxane structure is present in a large proportion in the organopolysiloxane compound in this art, and as a consequence it was found that the toner surface is susceptible to soften and the durability readily declines as a result.

Another method that can be contemplated is the external addition of an organopolysiloxane compound to the toner particles. In this case, however, liberation of the organopolysiloxane compound from the toner particle and burying in the toner particle occur during continuous image output and it is therefore difficult to obtain stable images over a long term.

As described above, in a toner containing an organopolysiloxane compound, problems still remain in achieving a better balance between the stability in a variety of environments and the durability and fixed image stability.

SUMMARY OF THE INVENTION

The present invention was achieved in view of the problems described above and provides a toner that achieves a balance between the stability in a variety of environments and the durability and fixed image stability.

The present invention relates to a toner that has a toner particle with a core-shell structure in which a shell phase containing a resin A is formed on a core that contains a binder resin, a colorant and a wax, wherein the resin A is a vinyl resin obtained by the copolymerization of a vinyl monomer X that has an organopolysiloxane structure and a vinyl monomer Y that has a polyester segment that forms a crystalline structure;

the content of the vinyl monomer X in a total monomer used for the copolymerization is from not less than 4.0 mass % to not more than 35.0 mass %;

the toner particle contains the resin A from not less than 2.0 mass % to not more than 33.0 mass %; and the binder resin contains a crystalline resin.

The present invention provides a toner that achieves a balance between the stability in a variety of environments and the durability and fixed image stability.

Further features of the present invention will become apparent from the following description of exemplary embodiments (with reference to the attached drawings).

DESCRIPTION OF THE EMBODIMENTS

Figure 1:
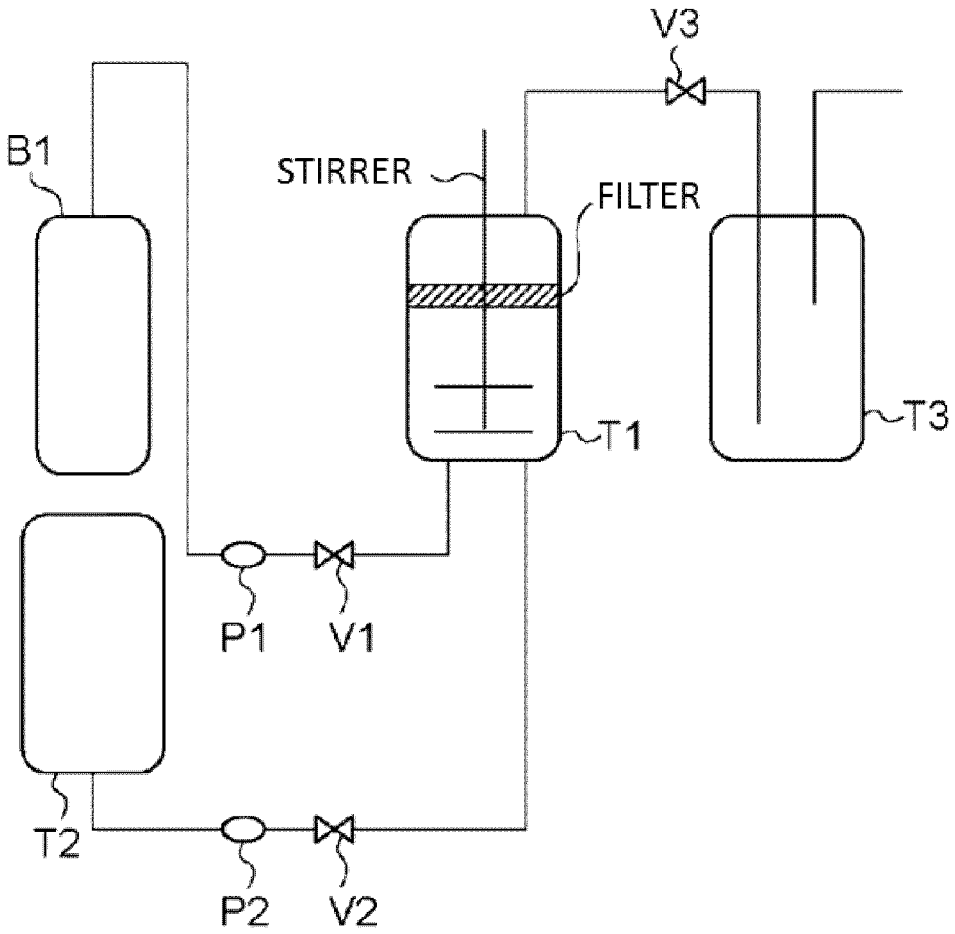
FIG. 1 is a drawing that illustrates an example of an apparatus for producing the toner of the present invention.

The toner of the present invention is a toner that has a toner particle with a core-shell structure in which a shell phase containing a resin A is formed on a core that contains a binder resin, a colorant and a wax, wherein the resin A is a vinyl resin obtained by the copolymerization of a vinyl monomer X that has an organopolysiloxane structure and a vinyl monomer Y that has a polyester segment that forms a crystalline structure;

the content of the vinyl monomer X is from not less than 4.0 mass % to not more than 35.0 mass %, where the total monomer used for the copolymerization is 100 mass %;

the aforementioned toner particle contains the resin A from not less than 2.0 mass % to not more than 33.0 mass %; and the binder resin contains a crystalline resin.

The resin forming the shell phase in the present invention will now be described.

The shell phase is desirably formed in a uniform, fine and dense manner on the surface of the core, but it is not limited as long as the structure is in the scope of the present invention.

The resin A is a vinyl resin obtained by the polymerization of the vinyl monomer X having the organopolysiloxane structure.

The organopolysiloxane structure is a structure that has a repeating unit of SiO bond wherein two alkyl groups are also bonded to this Si.

This organopolysiloxane structure has a low interfacial tension and an excellent stability in a variety of environments. Accordingly, the presence of the organopolysiloxane structure on the toner particle surface can, in particular from the aspect of the stability of the toner in a variety of environments, inhibit variations in the amount of charge in high-temperature, high-humidity environments and in low-temperature, low-humidity environments.

Organopolysiloxanes, on the other hand, generally have a glass transition temperature (Tg) below room temperature and thus are viscous liquids at room temperature. The surface of toner particle will therefore soften as the organopolysiloxane structure in the resin A increases. This results in a decrease of the durability.

In addition, due to its low interfacial tension as noted above, when an organopolysiloxane is present in large amounts in a toner particle, the adhesiveness between the melted toner and paper declines and the toner will then readily separate from the fixed image. Accordingly, in order to balance the stability in a variety of environments with the fixed image stability and durability, it becomes necessary for there to be little organopolysiloxane structure in the interior of the toner particle while the organopolysiloxane structure remains present to a certain degree at the surface of the toner particle.

The organopolysiloxane structure present on the surface of the toner particle can be detected by using X-ray photoelectron spectroscopic analysis (ESCA). The amount of Si present in the interior of the toner particle can be detected using X-ray fluorescence analysis (XRF).

In the present invention, when the total monomer used in the aforementioned copolymerization is 100 mass %, the proportion of the vinyl monomer X in the total monomer used for the copolymerization is from not less than 4.0 mass % to not more than 35.0 mass %. The organopolysiloxane structure becomes a favorable level in the resin A by having the composition of the resin A be as described above and the stability of the toner in a variety of environments and its durability and fixed image stability are then improved. The stability of the toner in a variety of environments declines when the vinyl monomer X is less than 4.0 mass %, while the durability of the toner declines when the vinyl monomer X exceeds 35.0 mass %. A preferred range for the vinyl monomer X is from not less than 5.0 mass % to not more than 20.0 mass %.

The vinyl monomer X having the organopolysiloxane structure in the present invention preferably has structures represented by the following formulas (1) and (2).

[Chem. 1]

formula (1)

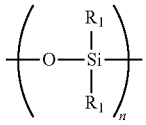

(In the formula, $R_1$ represents an alkyl group and the degree of polymerization n is an integer equal to 2 or more.)

[Chem. 2]

formula (2)

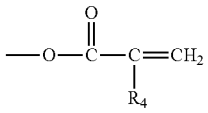

(In the formula, $R_4$ represents hydrogen or the methyl group.)

The vinyl monomer X having the organopolysiloxane structure more preferably has the structure represented by the following formula (3).

[Chem. 3]

formula (3)

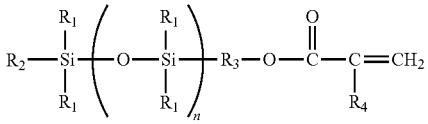

In formula (3), $R_1$ and $R_2$ each independently represent an alkyl group; $R_3$ presents an alkylene group; $R_4$ represents hydrogen or the methyl group; and n is the degree of polymerization and is an integer equal to 2 or more. These alkyl groups and the alkylene groups preferably have 1 to 3 carbons; and $R_1$ more preferably contains 1 carbon.

In the present invention, the degree of polymerization n in formulas (1) and (3) is preferably an integer equal to 2 or more and equal to 100 or less from a durability standpoint. More preferably, n is from not less than 2 to not more than 15.

Resin A is a vinyl resin that contains the vinyl monomer Y having a polyester segment that forms a crystalline structure as the structural components of the polymer, in addition to the vinyl monomer X. In the following, the "vinyl monomer Y having a polyester segment that forms a crystalline structure" is also represented as "vinyl monomer Y". The polyester segment that forms a crystalline structure is a segment that forms a regular alignment or arrangement and exhibits crystallinity, when the segment itself undergoes aggregation in large numbers, that is, it refers to a crystalline polyester component.

A crystalline polyester hardly soften up to the vicinity of its melting point, while it softens very rapidly over the vicinity of the melting point. Such a resin exhibits a clear melting peak in differential scanning calorimetric measurements using a differential scanning calorimeter (DSC). A crystalline polyester can easily infiltrate between the paper fibers due to its low post-melting viscosity. Due to this, when the resin A is a vinyl resin obtained by the copolymerization of the vinyl monomer Y in addition to the vinyl monomer X, the problem of facile separation of the toner from the fixed image due the presence of the organopolysiloxane structure can be easily countered. This therefore makes it possible to balance the stability of the fixed image with the stability in a variety of environments possessed by the organopolysiloxane group.

A aliphatic diol having 4 to 20 carbon atoms and polybasic carboxylic acid are preferably used as the starting materials for the crystalline polyester component. The aliphatic diol is also preferably a straight-chain aliphatic diol.

The straight-chain aliphatic diol preferably used in the present invention can be exemplified by the following, but is not limited thereto: 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. A mixture may also be used depending on the particular case. Viewed from the standpoint of the melting point, 1,4-butanediol, 1,5-pentanediol and 1,6-hexanediol are more preferred among the preceding.

The polyvalent carboxylic acid is preferably an aromatic dicarboxylic acid or aliphatic dicarboxylic acid. Among those, the aliphatic dicarboxylic acid is more preferred, and the straight-chain aliphatic dicarboxylic acid is particularly preferred.

The aliphatic dicarboxylic acids can be exemplified by the following, but is not limited thereto: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and their lower alkyl esters and acid anhydrides. A mixture may also be used depending on the particular case. Among those, sebacic acid, adipic acid, 1,10-decanedicarboxylic acid, and their lower alkyl esters and acid anhydrides are more preferred.

The aromatic dicarboxylic acids can be exemplified by the following: terephthalic acid, isophthalic acid, 2,6-naphthalenedicarboxylic acid, and 4,4'-biphenyldicarboxylic acid.

There are no particular limitations on the method of producing the crystalline polyester component under consideration, and the crystalline polyester component can be produced by general polyester polymerization methods in which the aforementioned acid component and alcohol component are reacted with each other. For example, the crystalline polyester component can be produced by using direct polycondensation or transesterification as appropriate depending on the type of monomer.

The production of the above-described crystalline polyester component is preferably carried out at a polymerization temperature from not less than 180° C. to not more than 230° C., and the reaction is preferably performed while removing the water and alcohol produced by the condensation, as necessary while reducing the pressure in the reaction system. When a monomer is not soluble or compatible at the reaction temperature, it may be dissolved by adding a solvent having a high-boiling point as a solubilizing agent. The polycondensation reaction is then performed while distilling the solubilizing agent out. When a poorly compatible monomer is present in the copolymerization reaction, the poorly compatible monomer is preferably condensed in advance with an acid or alcohol scheduled for polycondensation with this monomer, followed by polycondensation with the main component.

Catalysts usable in the production of the aforementioned crystalline polyester component can be exemplified by the following: titanium catalysts such as titanium tetraethoxide, titanium tetrapropoxide, titanium tetraisopropoxide and titanium tetrabutoxide, and tin catalysts such as dibutyltin dichloride, dibutyl tin oxide and diphenyltin oxide.

The melting point of the aforementioned crystalline polyester component is preferably from not less than 50° C. to not more than 120° C., and more preferably is from not less than 50° C. to not more than 90° C. when melting at the fixation temperature is taken into consideration.

The method of producing the vinyl monomer that contains the aforementioned crystalline polyester component can be exemplified by a method in which a urethanation reaction is performed on the crystalline polyester component and a hydroxyl group-containing vinyl monomer using a diisocyanate as a linker, thereby introducing a radical-polymerizable unsaturated group into the polyester chain and producing a urethane bond-containing monomer. As a consequence, the crystalline polyester component is preferably terminated by the alcohol. The molar ratio of the alcohol component to the acid component (alcohol component/carboxylic acid component) is therefore preferably from not less than 1.02 to not more than 1.20 when the crystalline polyester component is produced.

The aforementioned hydroxyl group-containing vinyl monomer can be exemplified by hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propargyl alcohol, 2-hydroxyethyl propenyl ether and sucrose allyl ether. Among those, hydroxyethyl acrylate and hydroxyethyl methacrylate are preferred.

The diisocyanate can be exemplified by the following: aromatic diisocyanates that have from 6 to 20 carbons (excluding the carbon in the NCO group; this also applies in the following), aliphatic diisocyanates that have from 2 to 18 carbons, alicyclic diisocyanates that have from 4 to 15 carbons, a modified substance of these diisocyanates (urethane group-containing modifications, carbodiimide group-containing modifications, allophanate group-containing modifications, urea group-containing modifications, biuret group-containing modifications, uretdione-group containing modifications, uretimine group-containing modifications, isocyanurate group-containing modifications and oxazolidone group-containing modifications, hereafter also called modified diisocyanates), and mixtures of two or more of the preceding.

The aliphatic diisocyanates can be exemplified by the following: ethylene diisocyanate, tetramethylene diisocyanate, hexamethylene diisocyanate (HDI) and dodecamethylene diisocyanate.

The alicyclic diisocyanates can be exemplified by the following: isophorone diisocyanate (IPDI), dicyclohexylmethane-4,4'-diisocyanate, cyclohexylene diisocyanate and methylcyclohexylene diisocyanate.

The aromatic diisocyanates can be exemplified by the following: m- and/or p-xylylene diisocyanate (XDI) and α,α,α',α'-tetramethylxylylene diisocyanate.

Among those, HDI, IPDI and XDI are preferably used.

A trifunctional or higher functional isocyanate compound can be used in addition to the above-described diisocyanates.

In the present invention, when total monomer used in the above-described copolymerization is 100 mass %, the proportion of the vinyl monomer Y in the total monomer used in this copolymerization is preferably from not less than 15.0 mass % to not more than 50.0 mass %. A balance between the stability in a variety of environments and the fixed image stability is even more easily achieved in this range.

The toner particle of the present invention is also characterized in that it contains the resin A from not less than 2.0 mass % to not more than 33.0 mass %. By using the indicated content for the resin A in the toner particle, an improvement in the fixed image stability is also made possible in addition to obtaining an improved stability of the toner in a variety of environments. When the content of the resin A is less than 2.0 mass %, the amount of the resin A present on the surface may not be adequate and the stability in a variety of environments will decline. At above 33.0 mass %, the shell phase becomes thick and the adhesiveness between the melted toner and paper declines and separation of the toner from the fixed image then occurs. A preferred range for the content of the resin A in the toner particle is from not less than 3.0 mass % to not more than 15.0 mass %.

Monomers which is used as the starting materials for the usual resin can be used as other vinyl monomer that can be copolymerized with vinyl monomer X and vinyl monomer Y for the resin A. Examples are provided below, but these are nonlimiting.

Aliphatic vinyl hydrocarbons: alkenes, for example, ethylene, propylene, butene, isobutene, pentene, heptene, diisobutylene, octene, dodecene, octadecene and α-olefins other than those described above; and alkadienes, for example, butadiene, isoprene, 1,4-pentadiene, 1,6-hexadiene and 1,7-octadiene.

Alicyclic vinyl hydrocarbons: mono- and dicycloalkenes and -alkadienes, for example, cyclohexene, cyclopentadiene, vinylcyclohexene and ethylidenebicycloheptene; and terpenes, for example, pinene, limonene and indene.

Aromatic vinyl hydrocarbons: styrene and its hydrocarbyl (alkyl, cycloalkyl, aralkyl and/or alkenyl)-substituted forms, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzene; and vinylnaphthalene.

Carboxyl group-containing vinyl monomers and their metal salts: carboxyl group-containing vinyl monomers such as unsaturated monocarboxylic acids and unsaturated dicarboxylic acids which have 3 to 30 carbon atoms and their anhydrides and monoalkyl (from not less than 1 to not more than 27 carbons) esters, for example, acrylic acid, methacrylic acid, maleic acid, maleic anhydride, the monoalkyl esters of maleic acid, fumaric acid, the monoalkyl esters of fumaric acid, crotonic acid, itaconic acid, the monoalkyl esters of itaconic acid, the glycol monoethers of itaconic acid, citraconic acid, the monoalkyl esters of citraconic acid and cinnamic acid.

Vinyl esters: for example, vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates each of which has an alkyl group (straight chain or branched) having 1 to 11 carbons (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, dialkyl fumarates (dialkyl esters of fumaric acid) (the two alkyl groups are straight chain, branched chain or alicyclic groups having 2 to 8 carbons), dialkyl maleates (dialkyl esters of maleic acid) (the two alkyl groups are straight chain, branched chain or alicyclic groups having 2 to 8 carbons), polyallyloxyalkanes (diallyloxyethane, triallyloxyethane, tetraallyloxyethane, tetraallyloxypropane, tetraallyloxybutane, tetramethallyloxyethane), vinyl monomers having a polyalkylene glycol chain (polyethylene glycol (molecular weight=300) monoacrylate, polyethylene glycol (molecular weight=300) monomethacrylate, polypropylene glycol (molecular weight=500) monoacrylate, polypropylene glycol (molecular weight=500) monomethacrylate, the acrylate of the 10 mol ethylene oxide (ethylene oxide is abbreviated below as EO) adduct on methyl alcohol, the methacrylate of the 10 mol ethylene oxide (ethylene oxide is abbreviated below as EO) adduct on methyl alcohol, the acrylate of the 30 mol EO adduct on lauryl alcohol, and the methacrylate of the 30 mol EO adduct on lauryl alcohol), and polyacrylates and polymethacrylates (the polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate and polyethylene glycol dimethacrylate.

Among those, the resin A is preferably a vinyl resin obtained by the copolymerization of styrene and methacrylic acid with the vinyl monomer X and the vinyl monomer Y.

The shell phase in the toner particle contains the resin A, but may additionally contain a resin B.

A crystalline resin or an amorphous resin may be used as the resin B. These may also be used in combination. Besides a crystalline polyester, a crystalline alkyl resin may also be used as the crystalline resin. The amorphous resin can be exemplified by polyurethane resins, polyester resins and vinyl resins such as styrene-acrylic resins and polystyrene, but this is nonlimiting. These resins may be modified with urethane, urea or epoxy.

The aforementioned crystalline alkyl resin is a vinyl resin obtained by the polymerization of an alkyl acrylate and alkyl methacrylate each of which has 12 to 30 carbons in order to exhibit crystallinity. When a vinyl monomer as described above is copolymerized, this can also be regarded as a crystalline alkyl resin to the extent that the crystallinity is not lost.

The aforementioned polyurethane resin as an amorphous resin is the reaction product of a diol component and a diisocyanate component that contains the diisocyanate group, and resins having various functionalities can be obtained by adjusting the diol component and the diisocyanate component. The diisocyanates as mentioned above can be favorably used as the diisocyanate component. The diol component can be exemplified by the following: alkylene glycols (ethylene glycol, 1,2-propylene glycol and 1,3-propylene glycol), alkylene ether glycols (polyethylene glycol and polypropylene glycol), alicyclic diols (1,4-cyclohexanedimethanol), bisphenols (bisphenol A) and alkylene oxide (ethylene oxide, propylene oxide) adducts on alicyclic diols. The alkyl moiety in the alkylene ether glycol may be straight chain or branched. An alkylene glycol with a branched structure can also be preferably used in the present invention.

The monomer used in the polyester resin as an amorphous resin can be exemplified by dihydric, or trihydric or higher hydric alcohols, and divalent, or trivalent or higher valent carboxylic acids as described in "Polymer Data Handbook: Basic Edition" (edited by The Society of Polymer Science, Japan: Baifukan Co., Ltd.). These monomer components can be specifically exemplified by the following compounds: the divalent carboxylic acids can be exemplified by dibasic acids such as succinic acid, adipic acid, sebacic acid, phthalic acid, isophthalic acid, terephthalic acid, malonic acid and dodecenylsuccinic acid and their anhydrides and lower alkyl esters, and by aliphatic unsaturated dicarboxylic acids such as maleic acid, fumaric acid, itaconic acid and citraconic acid, while the trivalent or higher valent carboxylic acids can be exemplified by 1,2,4-benzenetricarboxylic acid and its anhydride and lower alkyl esters. These may be used alone or may be used in combination.

The dihydric alcohol can be exemplified by the following compounds: bisphenol A, hydrogenated bisphenol A, the ethylene oxide adducts of bisphenol A, the propylene oxide adducts of bisphenol A, 1,4-cyclohexanediol, 1,4-cyclohexanedimethanol, ethylene glycol and propylene glycol. The trihydric or higher hydric alcohols can be exemplified by the following compounds: glycerol, trimethylolethane, trimethylolpropane and pentaerythritol. These may be used alone or may be used in combination. As necessary, a monovalent acid such as acetic acid or benzoic acid and/or a monohydric alcohol such as cyclohexanol or benzyl alcohol can also be used in order to adjust the acid value and/or the hydroxyl value.

The polyester resin as the amorphous resin can be synthesized by a known method using the monomer components described above.

The glass transition temperature (Tg) of the amorphous resin used for the resin B is preferably from not less than 50° C. to not more than 130° C. and more preferably is from not less than 50° C. to not more than 100° C.

There are no particular limitations in the present invention on the proportion of the resin A in the resin that forms the shell phase, but not less than 50.0 mass % is preferred. Preferably 100 mass % is the resin A in order to realize an even better stability in a variety of environments.

The weight-average molecular weight (Mw), as determined by gel permeation chromatography (GPC), of the tetrahydrofuran (THF)-soluble fraction of the resin that forms the shell phase in the present invention is preferably from not less than 20,000 to not more than 80,000. The use of this range makes it possible for the shell phase to have a favorable hardness and to improve the durability and to also maintain an excellent fixing performance.

The binder resin for the present invention will now be described. The binder resin in the present invention contains a crystalline resin. As described above, a crystalline resin denotes a resin that has a structure in which the molecular chains of the polymer are regularly arranged or aligned. Accordingly, a crystalline resin hardly soften up to the vicinity of the melting point, while it starts to melt from the vicinity of the melting point and suddenly softens. Such a resin exhibits a clear melting peak in differential scanning calorimetric measurements using a differential scanning calorimeter (DSC). After melting, a crystalline resin exhibits a low viscosity and thus will readily infiltrate between the paper fibers. This can readily counter the problem of facile separation of the toner from the fixed image due the presence of the organopolysiloxane structure. As a result, balance is even more readily achieved between the stability of the fixed image and the stability of the organopolysiloxane structure in a variety of environments. A crystalline polyester is particularly preferred for the crystalline resin.

The crystalline polyester is described in the following.

Monomer constituting the crystalline polyester component that can be used in the resin A described above is preferably used for the monomer used for this crystalline polyester in the present invention.

An aliphatic diol having a double bond can also be used as the aliphatic diol. This aliphatic diol having a double bond can be exemplified by the following compounds: 2-butene-1,4-diol, 3-hexene-1,6-diol and 4-octene-1,8-diol. A dicarboxylic acid having a double bond can also be used. Such a dicarboxylic acid can be exemplified by fumaric acid, maleic acid, 3-hexenedioic acid and 3-octenedioic acid, but there is no limitation to these. Their lower alkyl esters and acid anhydrides are additional examples. Among those, from a cost standpoint, fumaric acid and maleic acid are preferred.

The melting point of the crystalline resin contained in the binder resin used in the present invention is preferably from not less than 50° C. to not more than 90° C. When this range is satisfied, an excellent storage stability can be maintained and, in addition, a low viscosity is readily achieved during fixing and infiltration between the paper fibers is facilitated.

The melting point of the binder resin is preferably the same as or lower than the melting point of the shell phase. This further facilitates infiltration between the paper fibers by the binder resin which has taken on a low viscosity during fixing and thus readily provides an additional improvement in the stability of the fixed image.

The binder resin in the present invention contains a crystalline resin and may also contain an amorphous resin.

Amorphous resin that can be used in the binder resin in the present invention will now be described. The amorphous resin can be exemplified by polyurethane resins, polyester resins, and vinyl resins such as styrene-acrylic resins and polystyrene, but this is nonlimiting. These resins may be modified by urethane, urea or epoxy. Polyester resins and polyurethane resins are particularly advantageous from the standpoint of maintaining elasticity.

A resin usable for the resin B for the shell phase is preferably used for the aforementioned polyester resin for use as an amorphous resin. A resin usable for the resin B for the shell phase is preferably used for the aforementioned polyurethane resin for use as an amorphous resin.

The glass transition temperature (Tg) of the amorphous resin in the binder resin is preferably from not less than 50° C. to not more than 130° C. and more preferably is from not less than 50° C. to not more than 100° C. The elasticity in the fixing region is readily maintained in these ranges.

With regard to the proportions of the crystalline resin and amorphous resin in the binder resin in the present invention, the crystalline resin is preferably from not less than 30 mass % to not more than 85 mass %. A particularly good fixing performance is obtained in this range. Not less than 50 mass % is more preferred.

In a preferred embodiment of the present invention, a block polymer in which a moiety that can form a crystalline structure, i.e., a crystalline resin component, is chemically bonded with a moiety that cannot form a crystalline structure, i.e., an amorphous resin component, is used as the binder resin.

The block polymer can be any type of an AB diblock polymer, an ABA triblock polymer, a BAB triblock polymer, or an ABAB . . . multiblock polymer, which are composed of the crystalline resin component (A) and the amorphous resin component (B).

The method of producing the block polymer in the present invention can be a method in which the component that forms the crystalline moiety composed of the crystalline resin component is produced separately from the component that forms the amorphous moiety composed of the amorphous resin component and the two are bonded (two-stage method), or a method in which the starting materials for the component that forms the crystalline moiety and the component that forms the amorphous moiety are introduced simultaneously and production is performed at one time (single-stage method).

The block polymer in the present invention can be made by selecting from various methods considering the reactivity of the respective terminal functional groups.

When both the crystalline resin component and the amorphous resin component are polyester resins, the block polymer can be produced by preparing each component separately and then bonding using a linker. The reaction will proceed smoothly in the particular case that one polyester has a high acid value and the other polyester has a high hydroxyl value. The reaction temperature is preferably around 200° C.

The linker can be exemplified by the following when a linker is used: polyvalent carboxylic acids, polyhydric alcohols, polyvalent isocyanates, polyfunctional epoxies and polyvalent acid anhydrides. The synthesis can be performed by a dehydration reaction or addition reaction using these linkers.

When, on the other hand, the crystalline resin component is a crystalline polyester and the amorphous resin component is a polyurethane resin, production can be performed by separately producing the individual components and then performing a urethanation reaction between the terminal alcohol of the crystalline polyester and terminal isocyanate of the polyurethane. The synthesis can also be performed by mixing and heating an alcohol-terminated crystalline polyester with a diol and diisocyanate that will form the polyurethane resin. At the beginning of the reaction, where the diol and diisocyanate are present in high concentrations, the diol and diisocyanate selectively react with each other to provide the polyurethane resin. Once the molecular weight has increased to a certain degree, the urethanation reaction between the terminal isocyanate of the polyurethane resin and terminal alcohol of the crystalline polyester then occurs and the block polymer can be obtained.

The proportion of the crystalline resin component in this block polymer is preferably from not less than 30 mass % to not more than 85 mass %.

The toner particle used in the toner of the present invention contains a wax. The wax used in the present invention can be exemplified by the following: aliphatic hydrocarbon waxes such as low molecular weight polyethylenes, low molecular weight polypropylenes, low molecular weight olefin copolymers, microcrystalline waxes, paraffin waxes and Fischer-Tropsch waxes; oxides of aliphatic hydrocarbon waxes, such as oxidized polyethylene wax; waxes mainly contain an aliphatic acid ester, such as aliphatic hydrocarbon-type ester waxes; waxes obtained by the partial or complete deacidification of an aliphatic acid ester, such as deacidified carnauba wax; partial esters between aliphatic acids and polyhydric alcohols, such as monoglyceryl behenate; and methyl ester compounds having a hydroxyl group which is obtained by the hydrogenation of plant oils and fats.

Aliphatic hydrocarbon waxes and ester waxes are waxes particularly preferred for use in the present invention.

The ester wax in the present invention should have at least one ester bond in each molecule, and natural ester waxes and synthetic ester waxes may be used.

The synthetic ester waxes can be exemplified by monoester waxes synthesized from straight long-chain saturated aliphatic acids and straight long-chain saturated aliphatic alcohols. The straight long-chain saturated aliphatic acid used is preferably represented by the general formula $C_nH_{2n+1}COOH$ where n=not less than 5 and not more than 28. The straight long-chain saturated aliphatic alcohol used is preferably represented by the general formula $C_nH_{2n+1}OH$ where n=not less than 5 and not more than 28.

The natural ester waxes can be exemplified by candelilla wax, carnauba wax, rice wax and their derivatives.

Among those, waxes more preferred are synthetic ester waxes from straight long-chain saturated aliphatic acids and straight long-chain saturated aliphatic alcohols as well as natural waxes having such esters as their main component.

The content of the wax in the toner in the present invention is preferably from not less than 2 mass % to not more than 20 mass % and more preferably from not less than 2 mass % to not more than 15 mass %.

In the present invention, the wax preferably has a highest endothermic peak, according to differential scanning calorimetric measurement (DSC), in the range from not less than 60° C. to not more than 120° C. From not less than 60° C. to not more than 90° C. is more preferred.

The toner particle used in the toner of the present invention contains a colorant. The colorants preferably used in the present invention can be exemplified by organic pigments, organic dyes and inorganic pigments. The black colorant can be exemplified by carbon black and magnetic powders. In addition, the colorants heretofore used in toners can be used.

Yellow colorants can be exemplified by the following: condensed azo compounds, isoindolinone compounds, anthraquinone compounds, azo metal complexes, methine compounds and allylamide compounds. Specifically, C.I. Pigment Yellow 12, 13, 14, 15, 17, 62, 74, 83, 93, 94, 95, 109, 110, 111, 128, 129, 147, 155, 168 and 180 are preferably used.

Magenta colorants can be exemplified by the following: condensed azo compounds, diketopyrrolopyrrole compounds, anthraquinones, quinacridone compounds, basic dye lake compounds, naphthol compounds, benzimidazolone compounds, thioindigo compounds and perylene compounds. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are preferably used.

Cyan colorants can be exemplified by the following: copper phthalocyanine compounds and their derivatives, anthraquinone compounds and basic dye lake compounds. Specifically, C.I. Pigment Blue 1, 7, 15, 15:1, 15:2, 15:3, 15:4, 60, 62 and 66 are preferably used.

The colorant used in the toner of the present invention is selected with regard to hue angle, chroma, lightness, lightfastness, OHP transparency and dispersibility in the toner.

Excluding the use of a magnetic powder, the colorant is preferably used by being added at from not less than 1 mass % to not more than 20 mass % with reference to the toner. When a magnetic powder is used as the colorant, its amount of addition is preferably from not less than 40 mass % to not more than 150 mass % with reference to the toner.

As necessary, the toner particle in the toner of the present invention may contain a charge control agent. This may also be externally added to the toner particle. The incorporation of a charge control agent can stabilize the charging characteristics and makes possible control of the optimal triboelectric charge quantity in conformity to the development system.

A known charge control agent can be used in the present invention, and in particular, a charge control agent which can increase the charging speed and can stably maintain a specific or prescribed or constant amount of charge is preferably used.

Charge control agents that control the toner to a negative chargeability can be exemplified as follows. Organometal compounds and chelate compounds are effective, for example, monoazo-metal compounds, acetylacetone-metal compounds, and the metal compounds of aromatic oxycarboxylic acids, aromatic dicarboxylic acids, oxycarboxylic acids and dicarboxylic acids. Charge control agents that control the toner to a positive chargeability can be exemplified by the following: nigrosine, quaternary ammonium salts, the metal salts of higher fatty acids, diorganotin borates, guanidine compounds and imidazole compounds.

The content of the charge control agent is preferably from not less than 0.01 mass parts to not more than 20 mass parts per 100 mass parts of the binder resin and is more preferably from not less than 0.5 mass parts to not more than 10 mass parts per 100 mass parts of the binder resin.

The method of producing the toner particle of the present invention can be exemplified by the various methods for forming core-shell structures. Formation of the shell phase may be carried out at the same time as the core formation step or may be carried out after the core has been formed. Viewed from the standpoint of greater convenience, the core production step and the shell phase formation step are preferably carried out at the same time.

No limitations whatever are formed on the method for forming the shell phase. For example, when the shell phase is formed after the core has been formed, a method can be used in which the core and resin microparticles that will form the shell phase are dispersed in an aqueous medium and the resin microparticles are then aggregated and adsorbed to the surface of the core.

When the shell phase is formed at the same time as the core formation step, a solution suspension method is preferably used in which a resin composition obtained by dissolving a core-forming binder resin in an organic medium is dispersed in a dispersion medium in which a shell phase-forming microparticulate resin is dispersed, followed by removing the organic medium to obtain toner particles.

The toner particle of the present invention is particularly preferably produced in a nonaqueous medium. The use of a nonaqueous system makes it easier for the organopolysiloxane structure in resin A to orient to the surface of the toner particle and thereby facilitates a greater improvement in the stability in a variety of environments. Accordingly, the toner particle of the present invention is particularly advantageously produced by a solution suspension method in which high-pressure carbon dioxide is used as the dispersion medium.

Thus, in the present invention, the toner particle is preferably a toner particle formed by dispersing a resin composition in which the binder resin, colorant and wax are dissolved or dispersed in a medium that contains an organic solvent in a dispersion medium that contains high-pressure carbon dioxide and that contains resin microparticles that contain resin A, and by removing the organic solvent from the resulting dispersion. The dispersion medium is more preferably a dispersion medium in which the main component (not less than 50 mass %) is high-pressure carbon dioxide.

The high-pressure carbon dioxide that is preferably used in the present invention is carbon dioxide in a supercritical state or in a liquid state. Here, carbon dioxide in the liquid state refers to carbon dioxide residing at the temperature and pressure conditions in the region in the carbon dioxide phase diagram bounded by the solid/liquid boundary line, the critical temperature isotherm, and the gas/liquid boundary line that passes through the triple point (temperature=−57° C., pressure=0.5 MPa) and the critical point (temperature=31° C., pressure=7.4 MPa). Carbon dioxide in a supercritical state refers to carbon dioxide at temperature and pressure conditions greater than or equal to the aforementioned critical point for carbon dioxide.

In the present invention, an organic solvent may also be present as an additional component in the organic medium. In this case, the carbon dioxide and organic solvent preferably form a homogeneous phase.

A description follows of an example of a toner production method that is favorable in terms of obtaining the toner particle of the present invention and that uses supercritical or liquid carbon dioxide as the dispersion medium.

First, the colorant, wax and any other optional additives are added to an organic solvent capable of dissolving the binder resin and dispersion or dissolution to uniformity is carried out using a dispersing device such as a homogenizer, ball mill, colloid mill or ultrasonic disperser. Then, the obtained solution or dispersion (referred to hereafter simply as the resin composition) is dispersed in supercritical or liquid carbon dioxide to form oil droplets.

In this step, a dispersing agent is preferably dispersed in advance in the supercritical or liquid carbon dioxide that is used as the dispersion medium. The dispersing agent can be, for example, the resin A-containing resin microparticles for forming the shell phase, but another component may be mixed as the dispersing agent. For example, it may be an inorganic microparticulate dispersing agent, an organic microparticulate dispersing agent, or a mixture of these, and two or more may be used in combination in accordance with the particular objective.

The aforementioned inorganic microparticulate dispersing agent can be exemplified by alumina, zinc oxide, titania and calcium oxide inorganic particles.

In addition to the resin A, the aforementioned organic microparticulate dispersing agent can be exemplified by vinyl resins, urethane resins, epoxy resins, ester resins, polyamides, polyimides, silicone resins, fluororesins, phenolic resins, melamine resins, benzoguanamine resins, urea resins, aniline resins, ionomer resins, polycarbonates, cellulose, and mixtures of the preceding. These may form a crosslinked structure.

The aforementioned dispersing agent may be used as such, or a dispersing agent may be used that has been subjected to surface modification by any of various treatments in order to improve the adsorptivity to the surface of the oil droplets upon granulation. Specific examples are a surface treatment by a silane, titanate or aluminate coupling agent, surface treatment by any of various surfactants, and a coating treatment with a polymer. Since the organic microparticles serving as a dispersing agent adsorbed to the oil droplet surface remain as such also after toner particle formation, the resin A and any other resin used as the dispersing agent form the shell phase of the toner particle.

The particle diameter of the resin A-containing resin microparticles in the present invention is preferably from not less than 30 nm to not more than 300 nm, as the volume-average particle diameter. From not less than 50 nm to not more than 200 nm is more preferred. When the particle diameter is within this range, the oil droplets can exist with good stability during granulation.

The content of the aforementioned resin microparticles is preferably from not less than 1.0 mass part to not more than 35.0 mass parts per 100 mass parts of the solids fraction in the resin solution used for oil droplet formation, and can be suitably adjusted in conformity to oil droplet stability and the desired particle diameter.

Any method may be used in the present invention as the method for dispersing the dispersing agent in the liquid or supercritical carbon dioxide. A specific example is a method in which the dispersing agent and liquid or supercritical carbon dioxide are introduced into a container and dispersion is directly carried out using stirring or exposure to ultrasound. Another example is a method in which a dispersion composed of the dispersing agent dispersed in an organic solvent, is introduced using a high-pressure pump into a container in which liquid or supercritical carbon dioxide has been introduced.

Any method may be used in the present invention as the method for dispersing the resin composition in the liquid or supercritical carbon dioxide. A specific example is a method in which the resin composition is introduced using a high-pressure pump into a container holding the liquid or supercritical carbon dioxide in which the dispersing agent has been dispersed. In addition, the liquid or supercritical carbon dioxide in which the dispersing agent has been dispersed may be introduced into a container that holds the resin composition.

The dispersion medium provided by the liquid or supercritical carbon dioxide is preferably a single phase in the present invention. When granulation is carried out by dispersing the aforementioned resin composition in liquid or supercritical carbon dioxide, a portion of the organic solvent in the oil droplets transfers into the dispersion. In this step, the presence of the carbon dioxide phase in a state separated from the organic solvent phase causes a loss of stability by the oil droplets and is thus disfavored. Accordingly, the temperature and pressure of the dispersion medium and the amount of the resin composition relative to the liquid or supercritical carbon dioxide are preferably adjusted into ranges in which the carbon dioxide and organic solvent can form a homogeneous phase.

The temperature and pressure of the dispersion medium are determined preferably in consideration of the granulatability (ease of oil droplet formation) and the solubility in the dispersion medium of the constituent components of the resin composition. For example, the binder resin and/or wax in the resin composition may dissolve in the dispersion medium depending on the temperature and pressure conditions. As a general, lower temperatures and lower pressures result in a greater inhibition of the solubility of these components into the dispersion medium, but also make it easier for the oil droplets that have formed to aggregate and combine and thus reduce the granulatability. On the other hand, higher temperatures and higher pressures improve the granulatability, but also tend to make it easier for the aforementioned components to dissolve in the dispersion medium. Accordingly, the temperature of the dispersion medium in the production of the toner particle of the present invention is preferably in the temperature range from not less than 10° C. to not more than 40° C.

The pressure in the container where the dispersion medium is formed is preferably from not less than 1.0 MPa to not more than 20.0 MPa and more preferably is from not less than 2.0 MPa to not more than 15.0 MPa. The pressure in the present invention refers to the total pressure, when the dispersion medium contains a component other than carbon dioxide.

The proportion of the carbon dioxide in the dispersion medium in the present invention is preferably not less than 70 mass % and more preferably is not less than 80 mass % and even more preferably is not less than 90 mass %.

After the granulation has been completed, the organic solvent remaining in the oil droplets is removed through the dispersion medium provided by the liquid or supercritical carbon dioxide. Specifically, additional liquid or supercritical carbon dioxide is mixed with the dispersion medium in which the oil droplets are dispersed; the remaining organic solvent is extracted into the carbon dioxide phase; and the obtained organic solvent-containing carbon dioxide is replaced with additional liquid or supercritical carbon dioxide.

Mixing between the dispersion medium and the liquid or supercritical carbon dioxide may be carried out by adding to the dispersion medium the liquid or supercritical carbon dioxide with a higher pressure than that of the dispersion medium, or by adding the dispersion medium to the liquid or supercritical carbon dioxide with a lower pressure than that of the dispersion medium.

As a method for replacing the organic solvent-containing carbon dioxide with additional liquid or supercritical carbon dioxide, a method in which liquid or supercritical carbon dioxide is passed through while maintaining a constant pressure in the container is exemplified. This step is carried out while using a filter to trap the toner particles that have been formed.

When replacement by the liquid or supercritical carbon dioxide is insufficient and organic solvent remains in the dispersion medium, the organic solvent dissolved in the dispersion medium may condense when the container pressure is reduced in order to recover the obtained toner particles, and then can produce problems such as redissolution of the toner particles and cohesion of toner particles with each other. Accordingly, the replacement with liquid or supercritical carbon dioxide is preferably carried out until the organic solvent has been completely removed. The amount of liquid or supercritical carbon dioxide that is passed through is preferably from not less than 1-fold to not more than 100-fold, more preferably from not less than 1-fold to not more than 50-fold, and particularly more preferably from not less than 1-fold to not more than 30-fold, with respect to the volume of the dispersion medium.

When the container is depressurized to recover the toner particles from the dispersion containing liquid or supercritical carbon dioxide in which the toner particles are dispersed, the pressure reduction may be carried out in a single step to normal temperature and normal pressure, or a stagewise pressure reduction may be carried out by bringing the independently pressure-controlled container into multiple stages. The depressurization rate is preferably determined in a range in which there is no foaming of the toner particles.

The organic solvent and carbon dioxide used in the present invention can be recycled.

In the present invention, an inorganic fine powder is preferably added to the toner particles as a flowability improver. The inorganic fine powder added to the toner particles can be exemplified by fine powders such as silica fine powder, titanium oxide fine powder, alumina fine powder, and their multiple oxide fine powders. Silica fine powder and titanium oxide fine powder are preferred among the inorganic fine powders.

The silica fine powder can be exemplified by the fumed silicas and dry silicas produced via the vapor-phase oxidation of a silicon halide, and the wet silicas produced from water glass. A more preferred inorganic fine powder is a dry silica that contains little $Na_2O$ and $SO_3^{2-}$, and contains little silanol group on the surface and in the interior of the silica fine powder. In addition, the dry silica may be a composite fine powder of silica with another metal oxide, which is obtained by using a combination of the silicon halide compound with another metal halide compound, e.g., aluminum chloride or titanium chloride, in the production process.

The inorganic fine powder is preferably added externally to the toner particles in order to improve toner flowability and to uniformize toner charging. In addition, an inorganic fine powder that has been subjected to a hydrophobic treatment is more preferably used, because an improved regulation of the quantity of toner charge, an improved stability of the toner in a variety of environments, and improved properties in a high-humidity environment can be achieved by the hydrophobic treatment on the inorganic fine powder. When an inorganic fine powder added to the toner absorbs moisture, the quantity of toner charging is reduced, and thereby, the developing performance and transfer properties tend to be deteriorated.

The treatment agent for performing the hydrophobic treatment on the inorganic fine powder can be exemplified by unmodified silicone varnishes, various modified silicone varnishes, unmodified silicone oils, various modified silicone oils, silane compounds, silane coupling agents, other organosilicon compounds and organotitanium compounds. These treatment agents may be used alone or in combination.

Among those, silicone oil-treated inorganic fine powder is preferred. A silicone oil-treated hydrophobed inorganic fine powder, which is obtained by treating an inorganic fine powder with a silicone oil at the same time as or after a hydrophobic treatment with a coupling agent, is more preferred from the standpoint of reducing the selective developability and retaining a high quantity of toner charge even in a high-humidity environment.

The amount of addition of a silicone oil-treated hydrophobed powder obtained by treating an inorganic fine powder with a silicone oil at the same time as or after a hydrophobic treatment with a coupling agent is preferably from not less than 0.1 mass parts to not more than 4.0 mass parts with respect to 100 mass parts of the toner particles, and more preferably is from not less than 0.2 mass parts to not more than 3.5 mass parts.

The weight-average particle diameter (D4) of the toner of the present invention is preferably from not less than 3.0 μm to not more than 8.0 μm. From not less than 5.0 μm to not more than 7.0 μm is more preferred. The use of toner having such a weight-average particle diameter (D4) is preferred from the standpoint of achieving a highly satisfactory dot reproducibility while obtaining good handling properties.

The ratio D4/D1 between the weight-average particle diameter (D4) and the number-average particle diameter (D1) of the toner of the present invention is also preferably not more than 1.25. Not more than 1.20 is more preferred.

According to gel-permeation chromatographic (GPC) measurement of the tetrahydrofuran (THF)-soluble fraction, the toner of the present invention preferably has a number-average molecular weight (Mn) of from not less than 8,000 to not more than 40,000 and preferably has a weight-average molecular weight (Mw) of from not less than 15,000 to not more than 60,000. A favorable viscoelasticity can be imparted to the toner in these ranges. When Mn is less than 8,000 or Mw is less than 15,000, the toner will then be too soft and the resistance to hot storage will tend to decline. In addition, the toner will readily separate from the fixed image. When Mn is greater than 40,000 or Mw is greater than 60,000, the toner will then be too hard and the fixing performance is very prone to decline. A more preferred range for Mn is from not less than 10,000 to not more than 20,000, and a more preferred range for Mw is from not less than 20,000 to not more than 50,000. Mw/Mn is desirably not more than 6, while a more preferred range for Mw/Mn is not more than 3.

Methods for measuring the various properties of the toner materials and toner of the present invention are described in the following.

<Method of Measuring the Degree of Polymerization n of Vinyl Monomer X Having the Organopolysiloxane Structure>

The degree of polymerization n of vinyl monomer X having the organopolysiloxane structure is measured by 1H-NMR under the following conditions.

Measurement instrument: FT-NMR instrument, JNM-EX400 (JEOL Ltd.)

Measurement frequency: 400 MHz

Pulse condition: 5.0 μs

Frequency range: 10,500 Hz

Number of scans: 64

Measurement temperature: 30° C.

Sample: The sample is prepared by introducing 50 mg of the vinyl monomer X to be measured into a sample tube with an inner diameter of 5 mm, adding deuterochloroform ($CDCl_3$) as solvent, and dissolving in a thermostat at 40° C.

Using the obtained 1H-NMR chart, the integration value $S_1$ is determined for the peak (approximately 0.0 ppm) assigned to the hydrogen bonded to the carbon that is bonded to silicon. The integration value $S_2$ is similarly determined for the peak (approximately 6.0 ppm) assigned to one of the terminal hydrogens in the vinyl group. The degree of polymerization n of the vinyl monomer X is calculated as follows using this integration value $S_1$ and integration value $S_2$. Here, $n_1$ is the number of hydrogens bonded to the carbon that is bonded to silicon, wherein $n_1$ is 6 when $R_1$ in formula (1) is the methyl group and $n_1$ is 4 when $R_1$ in formula (1) is the ethyl group or larger.

Degree of polymerization $n$ of the vinyl monomer $$X=\{(S_1-n_1)/n_1\}/S_2$$

<Method of Measuring the Amount of Si from the Organopolysiloxane Structure by X-Ray Photoelectron Spectroscopic Analysis (ESCA)>

In the present invention, the amount of Si from the organopolysiloxane structure present on the toner particle surface is determined by analysis of the surface composition by X-ray photoelectron spectroscopic analysis (ESCA). The ESCA instrument and measurement conditions are as follows.

Instrument used: Quantum 2000 (ULVAC-PHI, Incorporated)

Analysis method: narrow analysis

Measurement Conditions:

X-ray source: Al-Kα

X-ray conditions: 100μ, 25 W, 15 kV

Photoelectron incidence angle: 45°

Pass energy: 58.70 eV

Measurement range: ϕ 100 μm

The measurement is carried out under the conditions indicated above and the peak originating with the C—C bond of carbon 1s orbit is corrected to 285 eV. The amount of Si originating with the organopolysiloxane structure with respect to the total amount of the constituent elements is subsequently determined from the peak area of the SiO bond of silicon 2p orbit, its peak top is detected at not less than 100 eV to not more than 103 eV, by using the relative sensitivity factor provided by ULVAC-PHI, Incorporated. When another Si 2p orbital peak ($SiO_2$: greater than 103 eV and not more than 105 eV) is detected, the SiO bond peak area is determined by carrying out waveform separationon the SiO bond peak.

<Method of Measuring the Amount of Si with an X-Ray Fluorescence Analyzer (XRF)≥

In the present invention, the Si content of the toner particles is determined by using an X-ray fluorescence analyzer. The elements from Na to U in the toner particle are directly measured by the FP method under a helium atmosphere using an Axios Advanced (PANalytical B.V.) wavelength-dispersive X-ray fluorescence analyzer. With respect to 100% of the total mass of the detected elements, the Si content (mass %) is determined with respect to the total mass using the UniQuant5 (ver. 5.49) software.

<Method of Measuring the Number-Average Molecular Weight (Mn) and Weight-Average Molecular Weight (Mw)>

The molecular weight (Mn, Mw) of the tetrahydrofuran (THF)-soluble fraction of the toner and so forth is measured in the present invention by GPC as follows.

First, the sample is dissolved in THF over 24 hours at room temperature. The obtained solution is filtered using a "MYSHORI Disk" solvent-resistant membrane filter with a pore diameter of 0.2 μm (Tosoh Corporation) to obtain a sample solution. The sample solution is adjusted so as to provide a concentration of THF-soluble components of approximately 0.8 mass %. Measurement is performed under the following conditions using this sample solution.

Instrument: HLC8120 GPC (detector: RI) (Tosoh Corporation)

Columns: 7 column train of Shodex KF-801, 802, 803, 804, 805, 806 and 807 (Showa Denko KK)

Eluent: tetrahydrofuran (THF)

Flow rate: 1.0 mL/min

Oven temperature: 40.0° C.

Sample injection amount: 0.10 mL

The sample molecular weight is determined using a molecular weight calibration curve constructed using standard polystyrene resin (product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Method of Measuring the Particle Diameter of the Colorant Particles, Wax Particles and Resin Microparticles for the Shell>

The particle diameter of the resin microparticles and so forth is measured as the volume-average particle diameter (μm or nm) by carrying out measurement in the 0.001 μm to 10 μm range setting using an HRA (X-100) Microtrac particle size distribution analyzer (Nikkiso Co., Ltd.). Water was selected for the dilution solvent.

<Method of Measuring the Melting Point of the Crystalline Polyester, Block Polymer and Wax and the Amount of Endothermic Heat and the Half-Width Value for the Crystalline Polyester>

The melting point of the crystalline polyester, block polymer and wax were measured under the following conditions using a DSC Q1000 (TA Instruments).

Rate of temperature rise: 10° C./min

Temperature at start of measurement: 20° C.

Temperature at end of measurement: 200° C.

The melting points of indium and zinc are used for temperature correction in the detection section of the instrument, and the heat of fusion of indium is used to correct the amount of heat. Specifically, approximately 2 mg of the sample is accurately weighed out and placed in a silver pan, and the measurement is carried out using an empty silver pan for reference. The measurement is performed after raising the temperature to 200° C., then lowering the temperature to 20° C., and thereafter raising the temperature once again. In the case of crystalline polyester and block polymer, the peak temperature of the highest endothermic peak in the DSC curve in the range from a temperature of 20° C. to 200° C. in the first temperature ramp-up step is taken to be the melting point of the crystalline polyester and block polymer, while in the case of wax, the peak temperature of the highest endothermic peak in the DSC curve in the range from a temperature of 20° C. to 200° C. in the second temperature ramp-up step is taken to be the melting point of the wax. When multiple peaks are present, the aforementioned highest endothermic peak refers to the peak with the largest amount of endothermic heat. For the crystalline polyester, ΔH (J/g) is taken to be the amount of endothermic heat for the endothermic peak from the temperature at which heat absorption starts to the temperature at which heat absorption is completed, and the half-width value (° C.) is taken to be the temperature width at half the peak height of the aforementioned highest endothermic peak.

<Method of Measuring the Glass Transition Temperature (Tg) of the Amorphous Resins>

Measurement of the Tg was performed in the present invention under the following conditions using a Q1000 (TA Instruments) DSC.

Modulation mode

Rate of temperature rise: 0.5° C./min

Modulation temperature amplitude: ±1.0° C./min

Temperature at start of measurement: 25° C.

Temperature at end of measurement: 130° C.

The temperature rise was carried out only once; the DSC curve was obtained by plotting the "Reversing Heat Flow" on the vertical axis; and the glass transition temperature (Tg) cited by the present invention was taken to be the onset value.

<Method of Measuring the Weight-Average Particle Diameter (D4) and the Number-Average Particle Diameter (D1) of the Toner>

The weight-average particle diameter (D4) and the number-average particle diameter (D1) of the toner are determined as follows. A "Coulter Counter Multisizer 3" (registered trademark, from Beckman Coulter, Inc.), a precision particle size distribution measurement instrument operating on the pore electrical resistance method and equipped with a 100 μm aperture tube, is used as the measurement instrument. The accompanying dedicated software "Beckman Coulter Multisizer 3 Version 3.51" (Beckman Coulter, Inc.) is used to set the measurement conditions and analyze the measurement data. The measurements are carried at 25,000 channels for the number of effective measurement channels.

The aqueous electrolyte solution used for the measurements can be an aqueous electrolyte solution prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modifying the standard measurement method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1,600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations/sec.

Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added approximately 0.3 mL of a dilution prepared by the approximately 3-fold (mass) dilution with ion-exchanged water of the dispersing agent "Contaminon N" (a 10 mass % aqueous solution (pH 7) of a neutral detergent for cleaning precision measurement instrumentation, comprising a nonionic surfactant, anionic surfactant and organic builder, Wako Pure Chemical Industries, Ltd.).

(3) An "Ultrasonic Dispersion System Tetora 150" (Nikkaki Bios Co., Ltd.), an ultrasound disperser with an electrical output of 120 W equipped with two oscillators of oscillation frequency 50 kHz disposed such that the phases are displaced by 180°, is prepared. Approximately 3.3 L of ion-exchanged water is introduced into the water tank of the ultrasound disperser and approximately 2 mL of Contaminon N is added to the water tank.

(4) The beaker described in (2) is set into the beaker holder opening on the ultrasound disperser and the ultrasound disperser is started. The height position of the beaker is adjusted in such a manner that the resonance condition of the surface of the aqueous electrolyte solution within the beaker is at a maximum.

(5) While the aqueous electrolyte solution within the beaker of (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be not less than 10° C. and no more than 40° C.

(6) The dispersed toner-containing aqueous electrolyte solution of (5) is dropped by using a pipette into the roundbottom beaker set in the sample stand as described in (1) to adjust a measurement concentration to approximately 5%. Measurement is then performed until the number of measured particles reaches 50,000.

(7) The measurement data is analyzed by the dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4), and when set to graph/number % with the dedicated software, the "average diameter" on the "analysis/numerical statistical value (arithmetic average)" screen is the number-average particle diameter (D1).

EXAMPLES

The present invention is specifically described below using production examples and examples, but these in no way limit the present invention. Unless specifically stated otherwise, the number of parts and % in the examples and comparative examples are on a mass basis in all instances.

<Synthesis of Crystalline Polyester 1>

While introducing nitrogen, the following starting materials were introduced into a two-neck flask that had been thermally dried.

| | |
|---|---|
| sebacic acid | 136.2 mass parts |
| 1,4-butanediol | 63.8 mass parts |
| dibutyltin oxide | 0.1 mass parts |

After the interior of the system had been substituted with nitrogen by a depressurization process, stirring was carried out for 6 hours at 180° C. The temperature was subsequently gradually raised to 230° C. under reduced pressure while continuing to stir, and holding for an additional 2 hours was carried out. When a thick and viscous condition was reached, air cooling was carried out and the reaction was stopped to synthesize a crystalline polyester 1. The properties of crystalline polyester 1 are given in Table 1.

<Synthesis of Crystalline Polyesters 2 to 6>

Crystalline polyesters 2 to 6 were obtained proceeding entirely as in the synthesis of crystalline polyester 1, but changing the starting material charge as shown in Table 1. The properties of crystalline polyesters 2 to 6 are shown in Table 1.

TABLE 1

| | Acid component | | Alchol component | | Alcohol/ | | | | | | Half- |
|---|---|---|---|---|---|---|---|---|---|---|---|
| | | Amount of addition (mass parts) | | Amount of addition (mass parts) | acid molar ratio | Mn | Mw | Mw/Mn | Melting point (° C.) | ΔH (J/g) | width value (° C.) |
| Crystalline polyester 1 | Sebacic acid | 136.2 | 1,4-butanediol | 63.8 | 1.05 | 5,100 | 11,500 | 2.3 | 66 | 118 | 3.6 |
| Crystalline polyester 2 | Sebacic acid | 137.5 | 1,4-butanediol | 62.5 | 1.02 | 12,700 | 59,000 | 4.6 | 65 | 120 | 5.1 |
| Crystalline polyester 3 | Sebacic acid | 134.0 | 1,4-butanediol | 66.0 | 1.11 | 2,500 | 4,500 | 1.8 | 66 | 118 | 3.6 |
| Crystalline polyester 4 | Sebacic acid | 119.1 | 1,6-hexanediol | 80.9 | 1.19 | 1,800 | 3,500 | 1.9 | 66 | 122 | 3.5 |
| Crystalline polyester 5 | Sebacic acid<br>Adipic acid | 111.0<br>20.5 | 1,4-butanediol | 68.5 | 1.12 | 2,400 | 4,400 | 1.8 | 61 | 115 | 3.4 |
| Crystalline polyester 6 | 1,16-hexadecanedicarboxylic acid | 150.0 | 1,4-butanediol | 50.0 | 1.16 | 2,400 | 4,400 | 1.8 | 83 | 113 | 3.4 |

<Synthesis of Amorphous Resin 1>

While introducing nitrogen, the following starting materials were introduced into a two-neck flask that had been thermally dried.

| | |
|---|---|
| polyoxypropylene(2.2)-2,2-bis(4-hydroxyphenyl)propane | 30.0 mass parts |
| polyoxyethylene(2.2)-2,2-bis(4-hydroxyphenyl)propane | 33.0 mass parts |
| terephthalic acid | 21.0 mass parts |
| trimellitic anhydride | 1.0 mass part |
| fumaric acid | 3.0 mass parts |
| dodecenylsuccinic acid | 12.0 mass parts |
| dibutyltin oxide | 0.1 mass parts |

After the interior of the system had been substituted with nitrogen using a depressurization process, stirring was carried out for 5 hours at 215° C. The temperature was subsequently gradually raised to 230° C. under reduced pressure while continuing to stir, and holding for an additional 2 hours was carried out. When a thick and viscous condition was reached, air cooling was carried out and the reaction was stopped to synthesize an amorphous resin 1, which was an amorphous polyester. Amorphous resin 1 had an Mn of 7,200, an Mw of 43,000 and a Tg of 63° C.

<Block Polymer Synthesis>

| | |
|---|---|
| crystalline polyester 1 | 210.0 mass parts |
| xylylene diisocyanate (XDI) | 56.0 mass parts |
| cyclohexanedimethanol (CHDM) | 34.0 mass parts |
| tetrahydrofuran (THF) | 300.0 mass parts |

While substituting with nitrogen, the preceding were introduced into a reactor equipped with a stirrer and a thermometer. This was heated to 50° C. and an urethanation reaction was carried out over 15 hours. 3.0 mass parts of salicylic acid was then added as a modifier to modify the isocyanate terminals. The THF solvent was distilled out to obtain the block polymer. This block polymer had an Mn of 14,600, an Mw of 33,100 and a melting point of 58° C.

<Preparation of the Block Polymer Solution>500.0 mass parts of acetone and 500.0 mass parts of the block polymer were introduced in a stirrer-equipped beaker and a block polymer solution was prepared by continuing to stir at a temperature of 40° C. until complete dissolution was achieved.

<Preparation of the Crystalline Polyester Solution>

500.0 mass parts of THF and 500.0 mass parts of crystalline polyester 2 were introduced into a stirrer-equipped beaker and a crystalline polyester solution was prepared by continuing to stir at a temperature of 40° C. until complete dissolution was achieved.

<Preparation of the Amorphous Resin Solution>

500.0 mass parts of acetone and 500.0 mass parts of amorphous resin 1 were introduced into a stirrer-equipped beaker and an amorphous resin solution was prepared by continuing to stir at a temperature of 40° C. until complete dissolution was achieved.

<Preparation of the Amorphous Resin Dispersion>

50.0 mass parts of amorphous resin 1 was dissolved in 200.0 mass parts of ethyl acetate and 3.0 mass parts of an anionic surfactant (sodium dodecylbenzenesulfonate) was added along with 200.0 mass parts of ion-exchanged water. Heating to 40° C. was carried out and stirring was performed for 10 minutes at 8,000 rpm using an emulsifying device (Ultra-Turrax T-50, IKA). This was followed by evaporation of the ethyl acetate to produce a dispersion of the amorphous resin.

<Synthesis of Vinyl-Modified Polyester Monomer 1>

| | |
|---|---|
| Xylylene diisocyanate (XDI) | 59.0 mass parts |

was introduced into a reactor fitted with a stirring rod and a thermometer and 41.0 mass parts of 2-hydroxyethyl methacrylate was added dropwise and a reaction was run for 4 hours at 55° C. to produce a vinyl-modified monomer intermediate.

Then,

| | |
|---|---|
| crystalline polyester 3 | 83.0 mass parts |
| THF | 100.0 mass parts |

were introduced into a reactor fitted with a stirring bar and a thermometer and dissolution at 50° C. was carried out. This was followed by the dropwise addition of 10.0 mass parts of the aforementioned vinyl-modified monomer intermediate and a reaction for 4 hours at 50° C. to obtain a vinyl-modified polyester monomer solution 1. The THF solvent was distilled out to obtain a vinyl-modified polyester monomer 1.

<Synthesis of Vinyl-Modified Polyester Monomers 2 to 4>

Vinyl-modified polyester monomers 2 to 4 were obtained by changing the crystalline polyester 3 in the synthesis of vinyl-modified polyester monomer 1 to crystalline polyesters 4 to 6.

<Preparation of Shell Resin Dispersion 1>

| | |
|---|---|
| vinyl-modified organopolysiloxane 1 (X-22-2475: n = 3, Shin-Etsu Chemical Co., Ltd.) | 15.0 mass parts |
| vinyl-modified polyester monomer 1 | 20.0 mass parts |
| styrene (St) | 55.0 mass parts |
| methacrylic acid (MAA) | 10.0 mass parts |
| azobismethoxydimethylvaleronitrile | 0.3 mass parts |
| normal-hexane | 80.0 mass parts |

The preceding were introduced into a beaker and were stirred and mixed at 20° C. to prepare a monomer solution, which was introduced into a dropping funnel that had been thermally dried beforehand. Separately, 276 mass parts of normal-hexane was introduced into a thermally dried two-neck flask. After substitution with nitrogen, the dropping funnel was mounted thereon and the monomer solution was added dropwise over 1 hour at 40° C. under airtight seal.

Stirring was continued for 3 hours after the completion of dropwise addition; a mixture of 0.3 mass parts of azobis-methoxydimethylvaleronitrile and 20.0 mass parts of normal-hexane was again added dropwise; and stirring was continued for 3 hours at 40° C. By cooling to room temperature, a shell resin dispersion 1 containing a shell resin 1 was obtained. The properties of shell resin dispersion 1 are shown in Table 2. In Table 2, the shell dispersion diameter is the volume-average particle diameter of the shell resin microparticles in the shell resin dispersion. The vinyl-modified organopolysiloxane 1 has the structure given by the following formula (3).

[Chem. 4]

formula (3)

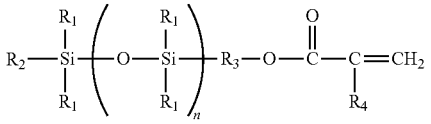

(In the formula, $R_1$, $R_2$ and $R_4$ represent the methyl group; $R_3$ represents the propylene group; and the degree of polymerization n is 3.)

TABLE 2

| | Used vinyl-modified organopolysiloxane | Polymerization ratio (mass %) in the shell resin: Vinyl-modified organopoly-siloxane | Behenyl acrylate | Vinyl-modified polyester monomer 1 | Vinyl-modified polyester monomer 2 | Vinyl-modified polyester monomer 3 | Vinyl-modified polyester monomer 4 | St | MAA | Shell dis-per-sion dia-meter (nm) | Mw |
|---|---|---|---|---|---|---|---|---|---|---|---|
| Shell resin dispersion 1 | Vinyl-modified organopolysiloxane 1 | 15.0 | — | 20.0 | — | — | — | 55.0 | 10.0 | 140 | 62,100 |
| Shell resin dispersion 2 | Vinyl-modified organopolysiloxane 1 | 35.0 | — | 20.0 | — | — | — | 35.0 | 10.0 | 150 | 60,200 |
| Shell resin dispersion 3 | Vinyl-modified organopolysiloxane 1 | 5.0 | — | 20.0 | — | — | — | 65.0 | 10.0 | 140 | 61,700 |
| Shell resin dispersion 4 | Vinyl-modified organopolysiloxane 1 | 4.0 | — | 20.0 | — | — | — | 66.0 | 10.0 | 160 | 62,500 |
| Shell resin dispersion 5 | Vinyl-modified organopolysiloxane 1 | 19.0 | — | 20.0 | — | — | — | 51.0 | 10.0 | 130 | 60,900 |
| Shell resin dispersion 6 | Vinyl-modified organopolysiloxane 1 | 21.0 | — | 20.0 | — | — | — | 49.0 | 10.0 | 140 | 61,500 |
| Shell resin dispersion 7 | Vinyl-modified organopolysiloxane 2 | 15.0 | — | 20.0 | — | — | — | 55.0 | 10.0 | 150 | 59,800 |
| Shell resin dispersion 8 | Vinyl-modified organopolysiloxane 3 | 15.0 | — | 20.0 | — | — | — | 55.0 | 10.0 | 140 | 64,100 |
| Shell resin dispersion 9 | Vinyl-modified organopolysiloxane 4 | 15.0 | — | 20.0 | — | — | — | 55.0 | 10.0 | 160 | 68,300 |
| Shell resin dispersion 10 | Vinyl-modified organopolysiloxane 5 | 15.0 | — | 20.0 | — | — | — | 55.0 | 10.0 | 170 | 78,800 |
| Shell resin dispersion 11 | Vinyl-modified organopolysiloxane 5 | 40.0 | — | 20.0 | — | — | — | 30.0 | 10.0 | 140 | 63,600 |
| Shell resin dispersion 12 | Vinyl-modified organopolysiloxane 1 | 40.0 | — | 20.0 | — | — | — | 30.0 | 10.0 | 150 | 61,900 |
| Shell resin dispersion 13 | Vinyl-modified organopolysiloxane 1 | 3.0 | — | 20.0 | — | — | — | 67.0 | 10.0 | 150 | 60,800 |
| Shell resin dispersion 14 | — | — | 15.0 | 20.0 | — | — | — | 55.0 | 10.0 | 150 | 63,300 |
| Shell resin dispersion 15 | Vinyl-modified organopolysiloxane 1 | 15.0 | — | 15.0 | — | — | — | 60.0 | 10.0 | 160 | 62,300 |
| Shell resin dispersion 16 | Vinyl-modified organopolysiloxane 1 | 15.0 | — | 40.0 | — | — | — | 35.0 | 10.0 | 140 | 64,300 |
| Shell resin dispersion 17 | Vinyl-modified organopolysiloxane 2 | 15.0 | — | — | 20.0 | — | — | 55.0 | 10.0 | 160 | 63,900 |
| Shell resin dispersion 18 | Vinyl-modified organopolysiloxane 3 | 15.0 | — | — | — | 20.0 | — | 55.0 | 10.0 | 150 | 62,900 |
| Shell resin dispersion 19 | Vinyl-modified organopolysiloxane 5 | 15.0 | — | 20.0 | — | — | 20.0 | 55.0 | 10.0 | 160 | 59,800 |
| Shell resin dispersion 20 | Vinyl-modified organopolysiloxane 1 | 15.0 | — | — | — | — | — | 75.0 | 10.0 | 150 | 63,100 |
| Shell resin dispersion 21 | — | — | 15.0 | 20.0 | — | — | — | 55.0 | 10.0 | 170 | 61,800 |
| Shell resin dispersion 22 | Vinyl-modified organopolysiloxane 4 | 12.0 | — | 20.0 | — | — | — | 58.0 | 10.0 | 170 | 61,700 |

St: styrene,
BA: n-utyl acrylate,
MAA: methacrylic acid

TABLE 3

| | Product name | Manufacturer | Degree of polymerization n | $R_1$ | $R_4$ |
|---|---|---|---|---|---|
| Vinyl-modified organo-poly-siloxane 1 | X-22-2475 | Shin-Etsu Chemical Co., Ltd. | 3 | Methyl group | Methyl group |
| Vinyl-modified organo-poly-siloxane 2 | FM-0711 | Chisso Corp. | 11 | Methyl group | Methyl group |
| Vinyl-modified organo-poly-siloxane 3 | X-22-174DX | Shin-Etsu Chemical Co., Ltd. | 60 | Methyl group | Methyl group |
| Vinyl-modified organo-poly-siloxane 4 | FM-0725 | Chisso Corp. | 133 | Methyl group | Methyl group |
| Vinyl-modified organo-poly-siloxane 5 | X-22-2426 | Shin-Etsu Chemical Co., Ltd. | 160 | Methyl group | Methyl group |

<Preparation of Shell Resin Dispersions 2 to 21>

Shell resin dispersions 2 to 21 containing shell resins 2 to 21 were obtained by changing the vinyl-modified organopolysiloxane, vinyl-modified polyester monomer, and amounts of other monomer addition in the preparation of shell resin dispersion 1 to that shown in Table 2. The vinyl-modified organopolysiloxane used is shown in Table 3. The properties of shell resin dispersions 2 to 21 are shown in Table 2.

<Preparation of Shell Resin Dispersion 22>

A shell resin 22 was prepared by changing the vinyl-modified organopolysiloxane and the amounts of other monomer addition in the preparation of shell resin dispersion 1 to that shown in Table 2 and distilling off the solvent and drying. 50.0 mass parts of the obtained shell resin 22 was dissolved in 200.0 mass parts of ethyl acetate and 3.0 mass parts of an anionic surfactant (sodium dodecylbenzenesulfonate) was added along with 200.0 mass parts of ion-exchanged water. Heating to 40° C. was carried out and stirring was performed for 10 minutes at 8,000 rpm using an emulsifying device (Ultra-Turrax T-50, IKA). This was followed by evaporation of the ethyl acetate to produce a shell resin dispersion 22. The properties of shell resin dispersion 22 are shown in Table 2.

<Preparation of Colorant Dispersion 1>

| | |
|---|---|
| C.I. Pigment Blue 15:3 | 100.0 mass parts |
| acetone | 150.0 mass parts |
| glass beads (1 mm) | 300.0 mass parts |

These materials were introduced into a heat-resistant glass container; dispersion was carried out for 5 hours using a paint shaker (Toyo Seiki Seisaku-sho Ltd.); and the glass beads were removed with a nylon mesh to obtain colorant dispersion 1 having a volume-average particle diameter of 200 nm and a solids fraction of 40 mass %.

<Preparation of Colorant Dispersion 2>

| | |
|---|---|
| C.I. Pigment Blue 15:3 | 50.0 mass parts |
| Neogen RK ionic surfactant (Dai-ichi Kogyo Seiyaku Co., Ltd.) | 5.0 mass parts |
| ion-exchanged water | 200.0 mass parts |

These materials were introduced into a heat-resistant glass container; dispersion was carried out for 5 hours using a paint shaker; and the glass beads were removed with a nylon mesh to obtain colorant dispersion 2 having a volume-average particle diameter of 220 nm and a solids fraction of 20 mass %.

<Preparation of Wax Dispersion 1>

| | |
|---|---|
| HNP10 paraffin wax (melting point: 75° C., Nippon Seiro Co., Ltd.) | 16.0 mass parts |
| nitrile group-containing styrene-acrylic resin (copolymer in which the constituent components are 60 mass parts of styrene, 30 mass parts of n-butyl acrylate and 10 mass parts of acrylonitrile, peak molecular weight = 8,500) | 8.0 mass parts |
| acetone | 76.0 mass parts |

The preceding were introduced into a glass beaker equipped with a stirring blade (IWAKI Glass Co., Ltd.) and the paraffin wax was dissolved in the acetone by heating the system to 70° C.

Cooling was gradually carried out while gently stirring the system at 50 rpm and a milky white liquid was obtained by cooling to 25° C. over 3 hours.

This solution was introduced into a heat-resistant container together with 20 mass parts of 1 mm glass beads and dispersion was performed for 3 hours using a paint shaker to obtain a wax dispersion 1 having a volume-average particle diameter of 270 nm and a solids fraction of 16 mass %.

<Preparation of Wax Dispersion 2>

| | |
|---|---|
| HNP10 paraffin wax (melting point: 75° C., Nippon Seiro Co., Ltd.) | 30.0 mass parts |
| Neogen RK cationic surfactant (Dai-ichi Kogyo Seiyaku Co., Ltd.) | 5.0 mass parts |
| ion-exchanged water | 270.0 mass parts |

The preceding were mixed and heated to 95° C. and thoroughly dispersed using an Ultra-Turrax T50 from IKA, followed by dispersion processing with a pressurized ejection-type Gaulin homogenizer to obtain wax dispersion 2 having a volume-average particle diameter of 200 nm and a solids fraction of 10 mass %.

EXAMPLE 1

Production of Toner Particle 1

In the apparatus shown in FIG. 1, first, valves V1 and V2 and pressure-adjustment valve V3 were closed; 32.0 mass parts of the shell resin microparticle dispersion 1 was introduced into a pressure-resistant granulation tank T1, which was equipped with a stirring mechanism and a filter for trapping the toner particles; and the internal temperature was adjusted to 15° C. Then, the valve V1 was opened; carbon dioxide (purity=99.99%) was introduced into the pressure-resistant container T1 from a cylinder B1 using a pump P1; and the valve V1 was closed when the internal pressure had reached 4.0 MPa. On the other hand, the block polymer solution, wax dispersion 1, colorant dispersion 1 and acetone were introduced into the resin solution tank T2 and the internal temperature was adjusted to 15° C.

The valve V2 was then opened and the contents of the resin solution tank T2 were introduced into the granulation tank T1 using a pump P2 while stirring the interior of the granulation tank T1 at 1,000 rpm, and the valve V2 was closed when the introduction of the entire amount was completed. After this introduction, the internal pressure in the granulation tank T1 had reached 7.0 MPa.

The amounts (mass ratio) of material introduction into T2 were as follows.

| | |
|---|---|
| block polymer solution | 150.0 mass parts |
| wax dispersion 1 | 30.0 mass parts |
| colorant dispersion 1 | 15.0 mass parts |
| acetone | 35.0 mass parts |
| carbon dioxide | 200.0 mass parts |

Using the equation of state described in the document (*Journal of Physical and Chemical Reference Data*, Vol. 25, pp. 1509-1596), the density of the carbon dioxide was calculated from the temperature (15° C.) and pressure (7 MPa) of the carbon dioxide, and the mass of the carbon dioxide introduced was then calculated by multiplying this by the volume of the granulation tank T1.

After the introduction of the contents of the resin solution tank T2 into the granulation tank T1 had been completed, granulation was carried out by stirring for 3 minutes at 1,000 rpm.

The valve V1 was then opened and carbon dioxide was introduced into the granulation tank T1 from the cylinder B1 using the pump P1. At this time, the pressure-adjustment valve V3 was set to 10 MPa and additional carbon dioxide was passed through while holding the internal pressure of the granulation tank T1 at 10 MPa. As a result of this process, carbon dioxide containing the organic solvent (mainly acetone) extracted from the liquid droplets post-granulation was discharged into a solvent recovery tank T3 and the organic solvent and carbon dioxide were separated.

The introduction of carbon dioxide into the granulation tank T1 was stopped at the point at which 15-times the mass of the carbon dioxide initially introduced into the granulation tank T1 was reached. The process of replacing the organic solvent-containing carbon dioxide with organic solvent-free carbon dioxide was completed at this point.

The toner particles 1 trapped in the filter were recovered by reducing the pressure in the granulation tank T1 to atmospheric pressure by opening the pressure-adjustment valve V3 a little at a time.

(Toner 1 Preparation Process)

1.8 mass parts of a hexamethyldisilazane-treated hydrophobic silica fine powder (number-average primary particle diameter: 7 nm) and 0.15 mass parts of a rutile titanium oxide fine powder (number-average primary particle diameter: 30 nm) were dry mixed into 100.0 mass parts of the toner particles 1 for 5 minutes in a Henschel mixer (Mitsui Mining Co., Ltd.) to produce a toner 1 of the present invention. The characteristics of toner 1 are shown in Table 5.

<Toner Evaluation Methods>

(Durability)

The durability was evaluated using a commercially available LBP5300 printer from Canon Inc. The LBP5300 uses single-component contact development and uses a toner control member to control the amount of toner on the developer carrying member. The cartridge used in the evaluation was obtained by removing the toner loaded in a commercial cartridge, cleaning the interior with an air blower, and loading with 160 g of the toner described above. The evaluation was performed with this cartridge installed in the cyan station and with dummy cartridges installed in the other stations.

An image with a print percentage of 1% was continuously output in a low-temperature, low-humidity (LL) environment of 15° C. and 10% RH. A solid image and a halftone image were output at each 1,000 prints output, and the presence/absence of the appearance of vertical streaks caused by melt adhesion of the toner to the control member, i.e., so-called development stripes, was visually checked. Image output was carried out to an endpoint of 15,000 prints. The results of the evaluation are shown in Table 6.

[Evaluation scale]

A: Did not appear even at 15,000 prints

B: Appeared at more than 13,000 prints, but at or below 15,000 prints

C: Appeared at more than 11,000 prints, but at or below 13,000 prints

D: Appeared at or below 11,000 prints

<Stability to Environment>

The difference in the quantity of charge in a low-temperature, low-humidity (LL) environment and a high-temperature, high-humidity (HH) environment was evaluated using the following method.

(Sample Preparation)

1.0 g of toner and 19.0 g of the designated carrier (Reference carrier according to The Imaging Society of Japan: a spherical carrier N-01 comprising a surface-treated ferrite core) are each placed in lidded plastic bottles and held for 5 days in an LL environment of temperature 15° C. and relative humidity 10% and an HH environment of temperature 32.0° C. and relative humidity 85%.

(Measurement of the Amount of Charge)

Figure 2:
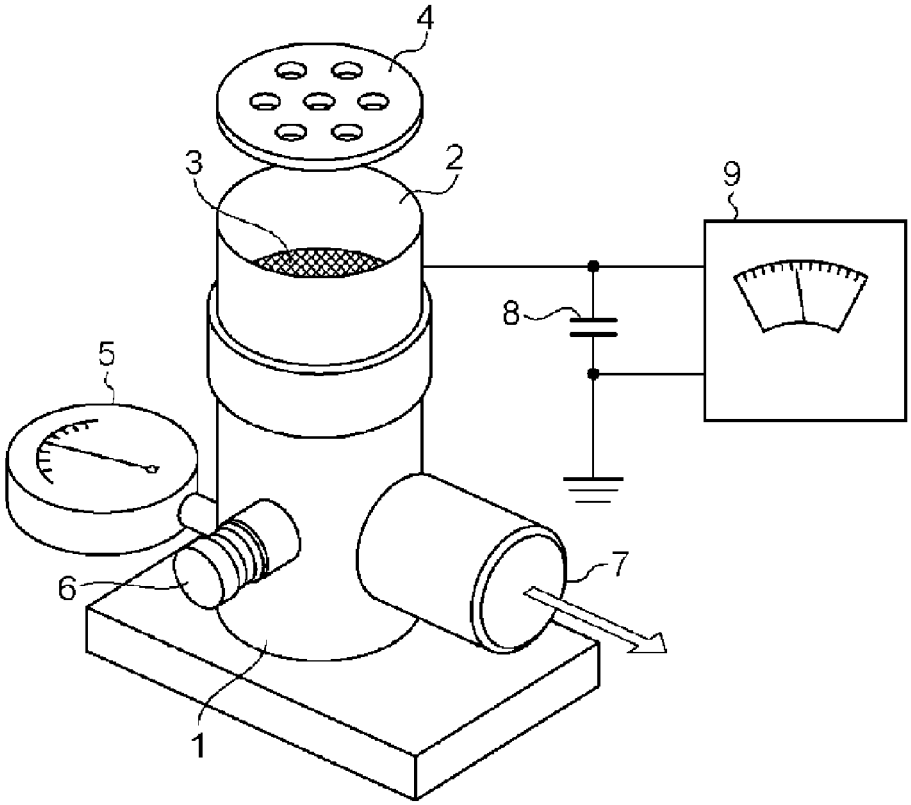
FIG. 2 is a drawing that illustrates an example of an apparatus for measuring the amount of charge on the toner of the present invention.

The lid is closed on the plastic bottle holding the carrier and toner described above, and the developer comprising the toner and carrier is charged by shaking with a shaker (YS-LD, Yayoi Co., Ltd.) for 1 minute at a speed of 4 back-and-forth excursions per second. The triboelectric charge quantity is then measured using a device, shown in FIG. 2, for measuring the triboelectric charge quantity. In FIG. 2, not less than 0.5 g to not more than 1.5 g of the aforementioned developer is introduced into a metal measurement container 2 having at its bottom a screen 3 with a 20 μm aperture, and a metal cap 4 is applied. The mass of the entire measurement container 2 at this point is accurately weighed and this is designated W1 (g). Then, in a suction apparatus 1 (at least the part in contact with the measurement container 2 is an insulator), suction is carried out through a suction port 7 and the pressure on a vacuum gauge 5 is brought to 2.5 kPa by adjusting the gas flowrate control valve 6. Suction is carried out for 2 minutes in this state to suction off the toner. The potential on a potentiometer 9 at this time is designated V (V). Here, 8 refers to a capacitor, and its capacity is designated C (mF). In addition, the mass of the entire measurement container is accurately weighed post-suction and this is designated W2 (g). The quantity of triboelectric charge Q (mC/kg) of the sample is then calculated using the following formula.

$$\text{triboelectric charge quantity } Q \text{ (mC/kg) of the sample} = C \times V / (W1 - W2)$$

Qh/Ql was taken to be the index of the environmental stability, where Ql (mC/kg) is the triboelectric charge quantity of the sample immediately after shaking for the LL environment and Qh (mC/kg) is the triboelectric charge quantity for the HH environment.

In addition, the stability to environment after durability testing was evaluated by outputting 10,000 prints of an image using the printer described above and performing the same evaluation on the toner removed from the cartridge. The results of the evaluations are shown in Table 6.

[Evaluation Scale]
A: not less than 0.90
B: not less than 0.80 but less than 0.90
C: not less than 0.70 but less than 0.80
D: less than 0.70

<Fixed Image Stability>

The fixed image stability was evaluated using the above-described LBP5300 printer. The cartridge described above was used as the evaluation cartridge, and it was installed in the cyan station of the LBP5300 after standing for 24 hours in a normal temperature, normal humidity (23° C., 60% RH) environment. Dummy cartridges were installed in the other stations. An unfixed toner image (toner laid-on level per unit area is 0.6 mg/cm$^2$) was then formed on rough paper (Xerox 4025: 75 g/m$^2$).

The fixing test was performed using a fixing unit that had been removed from the color laser printer referenced above and modified so the fixation temperature could be adjusted. The specific evaluation method is as follows.

The unfixed image referenced above was fixed in a normal temperature, normal humidity (23° C., 60% RH) environment with the process speed set to 190 mm/s and the temperature set to 110° C. The resulting fixed image was then rubbed back-and-forth 10 times with lens-cleaning paper to which a load of 14.7 kPa (150 g/cm$^2$) was applied, and the decline in the image density ΔD (%) before and after rubbing as indicated by the formula below was used as the index of the fixing performance. The results of the evaluation are shown in Table 5. The image density was evaluated using a reflection densitometer from X-Rite, Incorporated (500 Series Spectrodensitometer).

$$\Delta D\ (\%)=\{(\text{image density before rubbing}-\text{image density after rubbing})/\text{image density before rubbing}\}\times 100$$

[Evaluation Scale]
A: less than 3%
B: not less than 3% but less than 5%
C: not less than 5% but less than 7%
D: not less than 7% but less than 10%
E: at least 10%

Examples 2 to 22

Toners 2 to 22 of the present invention were obtained as in Example 1, but changing the amount of introduction of the materials, except for the acetone and carbon dioxide, in the toner particle 1 production process in Example 1 to that shown in Table 4. The characteristics of the obtained toners 2 to 22 are shown in Table 5 and the results of their evaluations are shown in Table 6.

TABLE 4

| | | Core resin | | Shell resin | |
|---|---|---|---|---|---|
| | | Used resin | Charged amount | Used resin | Charged amount |
| Example 1 | Toner 1 | Block polymer solution | 150.0 | Shell resin dispersion 1 | 32.0 |
| Example 2 | Toner 2 | Crystalline polyester solution | 75.0 | Shell resin dispersion 1 | 32.0 |
| | | Amorphous resin solution | 75.0 | | |
| Example 3 | Toner 3 | Block polymer solution | 150.0 | Shell resin dispersion 2 | 32.0 |
| Example 4 | Toner 4 | Block polymer solution | 150.0 | Shell resin dispersion 3 | 32.0 |
| Example 5 | Toner 5 | Block polymer solution | 150.0 | Shell resin dispersion 4 | 32.0 |
| Example 6 | Toner 6 | Block polymer solution | 135.0 | Shell resin dispersion 2 | 64.0 |
| Example 7 | Toner 7 | Block polymer solution | 160.0 | Shell resin dispersion 1 | 9.0 |
| Example 8 | Toner 8 | Block polymer solution | 155.0 | Shell resin dispersion 1 | 19.0 |
| Example 9 | Toner 9 | Block polymer solution | 80.0 | Shell resin dispersion 1 | 120.0 |
| Example 10 | Toner 10 | Block polymer solution | 135.0 | Shell resin dispersion 1 | 64.0 |
| Example 11 | Toner 11 | Block polymer solution | 135.0 | Shell resin dispersion 1 | 75.0 |
| Example 12 | Toner 12 | Block polymer solution | 150.0 | Shell resin dispersion 5 | 32.0 |
| Example 13 | Toner 13 | Block polymer solution | 150.0 | Shell resin dispersion 6 | 32.0 |
| Example 14 | Toner 14 | Block polymer solution | 150.0 | Shell resin dispersion 7 | 32.0 |
| Example 15 | Toner 15 | Block polymer solution | 150.0 | Shell resin dispersion 8 | 32.0 |
| Example 16 | Toner 16 | Block polymer solution | 150.0 | Shell resin dispersion 9 | 32.0 |
| Example 17 | Toner 17 | Block polymer solution | 150.0 | Shell resin dispersion 10 | 32.0 |
| Example 18 | Toner 18 | Block polymer solution | 150.0 | Shell resin dispersion 15 | 32.0 |
| Example 19 | Toner 19 | Block polymer solution | 150.0 | Shell resin dispersion 16 | 32.0 |
| Example 20 | Toner 20 | Block polymer solution | 150.0 | Shell resin dispersion 17 | 32.0 |
| Example 21 | Toner 21 | Block polymer solution | 150.0 | Shell resin dispersion 18 | 32.0 |
| Example 22 | Toner 22 | Block polymer solution | 135.0 | Shell resin dispersion 19 | 75.0 |
| Comparative Example 1 | Comparative toner 1 | Amorphous resin solution | 138.0 | Shell resin dispersion 11 | 60.0 |
| Comparative Example 2 | Comparative toner 2 | Amorphous resin dispersion | 80.0 | Shell resin dispersion 22 | 320.0(280.0 + 40.0) |
| Comparative Example 3 | Comparative toner 3 | Block polymer solution | 150.0 | Shell resin dispersion 14 | 32.0 |
| Comparative Example 4 | Comparative toner 4 | Block polymer solution | 150.0 | Shell resin dispersion 12 | 32.0 |
| Comparative Example 5 | Comparative toner 5 | Block polymer solution | 143.0 | Shell resin dispersion 13 | 46.0 |
| Comparative Example 6 | Comparative toner 6 | Block polymer solution | 150.0 | Shell resin dispersion 1 | 5.0 |
| | | | | Shell resin dispersion 14 | 27.0 |
| Comparative Example 7 | Comparative toner 7 | Block polymer solution | 75.0 | Shell resin dispersion 1 | 125.0 |
| Comparative Example 8 | Comparative toner 8 | Amorphous resin solution | 80.0 | Shell resin dispersion 1 | 120.0 |
| Comparative Example 9 | Comparative toner 9 | Block polymer solution | 150.0 | Shell resin dispersion 20 | 32.0 |
| Comparative Example 10 | Comparative toner 10 | Block polymer solution | 150.0 | Shell resin dispersion 21 | 32.0 |

| | | Wax | | Colorant | |
|---|---|---|---|---|---|
| | | Used wax | Charged amount | Used colorant | Charged amount |
| Example 1 | Toner 1 | Wax dispersion 1 | 30.0 | Colorant dispersion 1 | 15.0 |
| Example 2 | Toner 2 | Wax dispersion 1 | 30.0 | Colorant dispersion 1 | 15.0 |
| | | Wax dispersion 1 | | Colorant dispersion 1 | |

TABLE 4-continued

| | | | | | |
|---|---|---|---|---|---|
| Example 3 | Toner 3 | Wax dispersion 1 | 30.0 | Colorant dispersion 1 | 15.0 |
| Example 4 | Toner 4 | Wax dispersion 1 | 30.0 | Colorant dispersion 1 | 15.0 |
| Example 5 | Toner 5 | Wax dispersion 1 | 30.0 | Colorant dispersion 1 | 15.0 |
| Example 6 | Toner 6 | Wax dispersion 1 | 30.0 | Colorant dispersion 1 | 15.0 |
| Example 7 | Toner 7 | Wax dispersion 1 | 30.0 | Colorant dispersion 1 | 15.0 |
| Example 8 | Toner 8 | Wax dispersion 1 | 30.0 | Colorant dispersion 1 | 15.0 |
| Example 9 | Toner 9 | Wax dispersion 1 | 24.0 | Colorant dispersion 1 | 12.0 |
| Example 10 | Toner 10 | Wax dispersion 1 | 30.0 | Colorant dispersion 1 | 15.0 |
| Example 11 | Toner 11 | Wax dispersion 1 | 30.0 | Colorant dispersion 1 | 15.0 |
| Example 12 | Toner 12 | Wax dispersion 1 | 30.0 | Colorant dispersion 1 | 15.0 |
| Example 13 | Toner 13 | Wax dispersion 1 | 30.0 | Colorant dispersion 1 | 15.0 |
| Example 14 | Toner 14 | Wax dispersion 1 | 30.0 | Colorant dispersion 1 | 15.0 |
| Example 15 | Toner 15 | Wax dispersion 1 | 30.0 | Colorant dispersion 1 | 15.0 |
| Example 16 | Toner 16 | Wax dispersion 1 | 30.0 | Colorant dispersion 1 | 15.0 |
| Example 17 | Toner 17 | Wax dispersion 1 | 30.0 | Colorant dispersion 1 | 15.0 |
| Example 18 | Toner 18 | Wax dispersion 1 | 30.0 | Colorant dispersion 1 | 15.0 |
| Example 19 | Toner 19 | Wax dispersion 1 | 30.0 | Colorant dispersion 1 | 15.0 |
| Example 20 | Toner 20 | Wax dispersion 1 | 30.0 | Colorant dispersion 1 | 15.0 |
| Example 21 | Toner 21 | Wax dispersion 1 | 30.0 | Colorant dispersion 1 | 15.0 |
| Example 22 | Toner 22 | Wax dispersion 1 | 30.0 | Colorant dispersion 1 | 15.0 |
| Comparative Example 1 | Comparative toner 1 | Wax dispersion 1 | 30.0 | Colorant dispersion 1 | 15.0 |
| Comparative Example 2 | Comparative toner 2 | Wax dispersion 2 | 31.0 | Colorant dispersion 2 | 28.0 |
| Comparative Example 3 | Comparative toner 3 | Wax dispersion 1 | 30.0 | Colorant dispersion 1 | 15.0 |
| Comparative Example 4 | Comparative toner 4 | Wax dispersion 1 | 30.0 | Colorant dispersion 1 | 15.0 |
| Comparative Example 5 | Comparative toner 5 | Wax dispersion 1 | 30.0 | Colorant dispersion 1 | 15.0 |
| Comparative Example 6 | Comparative toner 6 | Wax dispersion 1 | 30.0 | Colorant dispersion 1 | 15.0 |
| Comparative Example 7 | Comparative toner 7 | Wax dispersion 1 | 23.0 | Colorant dispersion 1 | 12.0 |
| Comparative Example 8 | Comparative toner 8 | Wax dispersion 1 | 24.0 | Colorant dispersion 1 | 12.0 |
| Comparative Example 9 | Comparative toner 9 | Wax dispersion 1 | 30.0 | Colorant dispersion 1 | 15.0 |
| Comparative Example 10 | Comparative toner 10 | Wax dispersion 1 | 30.0 | Colorant dispersion 1 | 15.0 |

TABLE 5

| | | Content of resin A in the toner particle (mass %) | D4 (μm) | D1 (μm) | D4/D1 | Mn | Mw | Mw/Mn |
|---|---|---|---|---|---|---|---|---|
| Example 1 | Toner 1 | 7.0 | 5.8 | 5.2 | 1.12 | 16,800 | 38,800 | 2.3 |
| Example 2 | Toner 2 | 7.0 | 5.9 | 5.2 | 1.13 | 16,900 | 39,000 | 2.3 |
| Example 3 | Toner 3 | 7.0 | 6.2 | 5.4 | 1.15 | 16,800 | 38,700 | 2.3 |
| Example 4 | Toner 4 | 7.0 | 6.1 | 5.1 | 1.20 | 16,400 | 38,500 | 2.3 |
| Example 5 | Toner 5 | 7.0 | 6.2 | 5.3 | 1.17 | 17,000 | 38,900 | 2.3 |
| Example 6 | Toner 6 | 14.0 | 5.9 | 5.1 | 1.16 | 18,800 | 41,200 | 2.2 |
| Example 7 | Toner 7 | 2.0 | 6.0 | 5.1 | 1.18 | 14,900 | 35,400 | 2.4 |
| Example 8 | Toner 8 | 4.0 | 6.0 | 5.2 | 1.15 | 15,800 | 36,000 | 2.3 |
| Example 9 | Toner 9 | 33.0 | 6.1 | 5.5 | 1.11 | 19,800 | 44,400 | 2.2 |
| Example 10 | Toner 10 | 14.0 | 5.9 | 5.1 | 1.16 | 18,700 | 41,000 | 2.2 |
| Example 11 | Toner 11 | 16.0 | 5.8 | 5.2 | 1.12 | 18,900 | 41,700 | 2.2 |
| Example 12 | Toner 12 | 7.0 | 5.7 | 5.1 | 1.12 | 16,800 | 38,900 | 2.3 |
| Example 13 | Toner 13 | 7.0 | 6.0 | 5.2 | 1.15 | 16,600 | 39,100 | 2.4 |
| Example 14 | Toner 14 | 7.0 | 6.1 | 5.2 | 1.17 | 16,600 | 38,900 | 2.3 |
| Example 15 | Toner 15 | 7.0 | 6.2 | 5.3 | 1.17 | 16,800 | 38,600 | 2.3 |
| Example 16 | Toner 16 | 7.0 | 5.7 | 5.1 | 1.12 | 16,400 | 38,500 | 2.3 |
| Example 17 | Toner 17 | 7.0 | 5.9 | 5.1 | 1.16 | 16,700 | 38,600 | 2.3 |
| Example 18 | Toner 18 | 7.0 | 5.9 | 5.3 | 1.11 | 16,700 | 39,000 | 2.3 |
| Example 19 | Toner 19 | 7.0 | 6.0 | 5.2 | 1.15 | 16,500 | 38,700 | 2.3 |
| Example 20 | Toner 20 | 7.0 | 6.1 | 5.3 | 1.15 | 16,800 | 38,800 | 2.3 |
| Example 21 | Toner 21 | 7.0 | 5.7 | 5.1 | 1.12 | 16,400 | 38,100 | 2.3 |
| Example 22 | Toner 22 | 16.0 | 5.8 | 5.1 | 1.14 | 16,800 | 37,900 | 2.3 |
| Comparative Example 1 | Comparative toner 1 | 13.0 | 6.1 | 5.6 | 1.09 | 13,800 | 41,000 | 3.0 |
| Comparative Example 2 | Comparative toner 2 | 70.0 | 6.1 | 5.2 | 1.17 | 21,200 | 51,200 | 2.4 |
| Comparative Example 3 | Comparative toner 3 | — | 5.9 | 5.4 | 1.09 | 16,600 | 38,700 | 2.3 |
| Comparative Example 4 | Comparative toner 4 | 7.0 | 5.7 | 5.2 | 1.10 | 16,800 | 38,400 | 2.3 |
| Comparative Example 5 | Comparative toner 5 | 10.0 | 6.2 | 5.4 | 1.15 | 17,400 | 39,600 | 2.3 |
| Comparative Example 6 | Comparative toner 6 | 1.0 | 6.1 | 5.5 | 1.11 | 14,500 | 35,100 | 2.4 |
| Comparative Example 7 | Comparative toner 7 | 35.0 | 5.9 | 5.2 | 1.13 | 20,100 | 44,800 | 2.2 |
| Comparative Example 8 | Comparative toner 8 | 33.0 | 5.8 | 5.1 | 1.14 | 14,200 | 44,600 | 3.1 |
| Comparative Example 9 | Comparative toner 9 | 7.0 | 5.9 | 5.1 | 1.16 | 16,700 | 38,600 | 2.3 |
| Comparative Example 10 | Comparative toner 10 | — | 5.8 | 5.1 | 1.14 | 16,800 | 38,800 | 2.3 |

TABLE 6

| | Stability to Environment | | Durability | Fixed image stability |
|---|---|---|---|---|
| | Qh/Ql | Qh/Ql after passage of 10,000 sheets of paper | Number of prints at which development stripes appeared (number of prints) | Decline in density due to rubbing, for fixing at 110° C. (%) |
| Example 1 | A(0.98) | A(0.96) | A (had not appeared at 15,000) | A(1) |
| Example 2 | A(0.98) | A(0.95) | A (had not appeared at 15,000) | B(3) |
| Example 3 | A(0.98) | C(0.76) | C(12000) | B(3) |
| Example 4 | B(0.81) | C(0.76) | A (had not appeared at 15,000) | A(1) |
| Example 5 | C(0.75) | C(0.72) | A (had not appeared at 15,000) | A(1) |
| Example 6 | A(0.98) | C(0.75) | C(12000) | C(6) |
| Example 7 | C(0.75) | C(0.73) | A (had not appeared at 15,000) | A(1) |
| Example 8 | B(0.81) | C(0.79) | A (had not appeared at 15,000) | A(1) |
| Example 9 | A(0.98) | A(0.95) | A (had not appeared at 15,000) | C(6) |
| Example 10 | A(0.97) | A(0.95) | A (had not appeared at 15,000) | B(4) |
| Example 11 | A(0.97) | A(0.94) | A (had not appeared at 15,000) | C(6) |
| Example 12 | A(0.98) | A(0.91) | B(14000) | A(1) |
| Example 13 | A(0.98) | A(0.91) | C(13000) | A(1) |
| Example 14 | A(0.97) | A(0.91) | B(15000) | A(1) |
| Example 15 | A(0.96) | B(0.89) | B(14000) | A(1) |
| Example 16 | A(0.97) | B(0.83) | C(13000) | A(1) |
| Example 17 | A(0.97) | C(0.79) | C(12000) | A(2) |
| Example 18 | A(0.95) | A(0.92) | A (had not appeared at 15,000) | B(4) |
| Example 19 | A(0.98) | A(0.97) | A (had not appeared at 15,000) | A(1) |
| Example 20 | A(0.97) | A(0.91) | B(15000) | A(1) |
| Example 21 | A(0.96) | B(0.89) | B(14000) | A(1) |
| Example 22 | A(0.97) | C(0.79) | C(12000) | C(6) |
| Comparative Example 1 | A(0.92) | D(0.61) | D(10000) | E(12) |
| Comparative Example 2 | A(0.91) | C(0.76) | C(12000) | E(18) |
| Comparative Example 3 | A(0.88) | D(0.68) | A (had not appeared at 15,000) | A(2) |
| Comparative Example 4 | A(0.97) | D(0.69) | D(10000) | B(3) |
| Comparative Example 5 | D(0.65) | D(0.62) | A (had not appeared at 15,000) | B(3) |
| Comparative Example 6 | D(0.68) | D(0.66) | A (had not appeared at 15,000) | A(1) |
| Comparative Example 7 | A(0.98) | A(0.94) | A (had not appeared at 15,000) | E(12) |
| Comparative Example 8 | A(0.91) | B(0.86) | B(15000) | D(9) |
| Comparative Example 9 | B(0.88) | B(0.84) | A (had not appeared at 15,000) | E(12) |
| Comparative Example 10 | D(0.63) | D(0.60) | A (had not appeared at 15,000) | A(1) |

Comparative Example 1

A comparative toner 1 was obtained as in Example 1, but changing the amount of introduction of the materials, except for the acetone and carbon dioxide, in the toner particle 1 production process in Example 1 to that shown in Table 4. The characteristics of the obtained comparative toner 1 are shown in Table 5 and the results of its evaluations are shown in Table 6.

Comparative Example 2

Process of Producing Comparative Toner Particle 2

| | |
|---|---|
| amorphous resin dispersion | 80.0 mass parts |
| shell resin dispersion 21 | 280.0 mass parts |
| colorant dispersion 2 | 28.0 mass parts |
| wax dispersion 2 | 31.0 mass parts |
| 10 mass % aqueous solution of polyaluminum chloride | 1.5 mass parts |

The preceding were mixed in a round stainless steel flask and were mixed and dispersed using an Ultra-Turrax T50 from IKA; this was followed by holding for 60 minutes at 45° C. while stirring. 40.0 mass parts of the shell resin dispersion 21 was then slowly added and the pH in the system was brought to 6 with a 0.5 mol/L aqueous sodium hydroxide solution. The stainless steel flask was then sealed and was heated to 96° C. while continuing to stir using a magnetic seal. In the interval up to and including the temperature ramp up, supplemental additions of the aqueous sodium hydroxide solution were made as appropriate to prevent the pH from falling below 5.5. This was followed by holding for 5 hours at 96° C.

The end of the reaction was followed by cooling, filtration, and thorough washing with ion-exchanged water and then solid-liquid separation using a Nutsche-type suction filter. Redispersion into another 3 L of ion-exchanged water was carried out and stirring/washing for 15 minutes at 300 rpm was performed. This was repeated an additional 5 times to bring the pH of the filtrate to 7.0, and solid-liquid separation was then carried out using a Nutsche-type suction filter on No. 5A filter paper. Vacuum drying was subsequently continued for 12 hours to yield comparative toner particles 2.

Process of Producing Comparative Toner 2

1.8 mass parts of a hexamethyldisilazane-treated hydrophobic silica fine particles (number-average primary particle diameter: 7 nm) and 0.15 mass parts of rutile titanium oxide fine particles (number-average primary particle diameter: 30 nm) were dry mixed into 100 mass parts of the comparative toner particles 2 for 5 minutes in a Henschel mixer (Mitsui Mining Co., Ltd.) to produce a comparative toner 2. The characteristics of comparative toner 2 are shown in Table 5 and the results of its evaluations are shown in Table 6.

Comparative Example 3

Process of Producing Comparative Toner Particle 3

A comparative toner particle 3 was obtained by changing the amount of introduction of the materials, except for the acetone and carbon dioxide, in the toner particle 1 production process in Example 1 to that shown in Table 4.

Process of Producing Comparative Toner 3

1.8 mass parts of a hexamethyldisilazane-treated hydrophobic silica fine powder (number-average primary particle diameter: 7 nm), 0.15 mass parts of a rutile titanium oxide fine powder (number-average primary particle diameter: 30 nm), and 3.0 mass parts of spherical silicone resin fine particles XC99-A8808 (Momentive Performance Materials Inc.) were dry mixed into 100.0 mass parts of the comparative toner particles 3 for 5 minutes in a Henschel mixer (Mitsui Mining Co., Ltd.) to produce a comparative toner 3. The characteristics of comparative toner 3 are shown in Table 5 and the results of its evaluations are shown in Table 6.

Comparative Examples 4 to 10

Comparative toners 4 to 10 were obtained as in Example 1, but changing the amount of introduction of the materials, except for the acetone and carbon dioxide, in the toner particle 1 production process in Example 1 to that shown in Table 4. The characteristics of the obtained comparative toners 4 to 10 are shown in Table 5 and the results of their evaluations are shown in Table 6.

REFERENCE SIGNS LIST

1 Suction apparatus (at least the part in contact with the measurement container 2 is an insulator)
2 Metal measurement container
3 Screen
4 Metal cap
5 Vacuum gauge
6 Gas flowrate control valve
7 Suction port
8 Capacitor
9 Potentiometer
T1 Granulation tank
T2 Resin solution tank
T3 Solvent recovery tank
B1 Carbon dioxide cylinder
P1, P2 Pump
V1, V2 Valve
V3 Pressure-adjustment valve While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-260888, filed on Nov. 29, 2011, and Japanese Patent Application No. 2011-125763, filed on Jun. 3, 2011, both of which are hereby incorporated by reference herein in their entirety.

What is claimed is:

1. A toner comprising toner particles wherein:

each of the toner particles has a core-shell structure composed of a core and a shell phase formed on the core, the shell phase contains a resin A, the core contains a binder resin, a colorant and a wax, wherein the resin A is a vinyl resin prepared by copolymerizing a vinyl monomer X that has an organopolysiloxane structure and a vinyl monomer Y that has a polyester segment capable of forming a crystalline structure;

the content ratio of the vinyl monomer X to the total monomer used for the copolymerization is from not less than 4.0 mass % to not more than 35.0 mass %;

each of the toner particles contains the resin A from not less than 2.0 mass % to not more than 33.0 mass %; and the binder resin contains a crystalline resin.

2. The toner according to claim 1, wherein the vinyl monomer X that has the organopolysiloxane structure has a structure represented by the following formula (3):

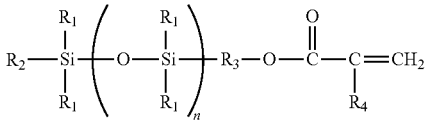

(3)

(In the formula, $R_1$ and $R_2$ each independently represent an alkyl group; $R_3$ represents an alkylene group; $R_4$ represents hydrogen or the methyl group; and the degree of polymerization n is an integer equal to 2 or more).

3. The toner according to claim 1, wherein the resin A is a vinyl resin prepared by copolymerizing the vinyl monomer X, the vinyl monomer Y, styrene and methacrylic acid.

4. The toner according to claim 1, wherein the binder resin is a block polymer in which a crystalline resin component is chemically bonded to an amorphous resin component.

5. The toner according to claim 1, wherein the content ratio of the vinyl monomer X to the total monomer used for the copolymerization is from not less than 5.0 mass % to not more than 20.0 mass %.

6. The toner according to claim 1, wherein each of the toner particles contains from not less than 3.0 mass % to not more than 15.0 mass % of the resin A.

7. The toner according to claim 2, wherein the degree of polymerization n in formula (3) is an integer equal to 2 or more and equal to 100 or less.

8. The toner according to claim 2, wherein the degree of polymerization n in formula (3) is an integer equal to 2 or more and equal to 15 or less.

9. The toner according to claim 1, wherein the toner particles are formed by dispersing a resin composition containing the binder resin, the colorant and the wax dissolved or dispersed in a medium that contains an organic solvent, in a dispersion medium that has carbon dioxide in a supercritical or liquid state and that contains a resin microparticle that contains the resin A, and removing the organic solvent from the resulting dispersion.

* * * * *